United States Patent [19]

Nelson

[11] Patent Number: 5,005,531

[45] **Date of Patent: * Apr. 9, 1991**

[54] THERMAL INSULATION JACKET

[76] Inventor: Thomas E. Nelson, 6100 Old La Grange Rd., Crestwood, Ky. 40014

[ * ] Notice: The portion of the term of this patent subsequent to Nov. 7, 2006 has been disclaimed.

[21] Appl. No.: 557,171

[22] Filed: Jul. 23, 1990

Related U.S. Application Data

[63] Continuation of Ser. No. 412,923, Sep. 26, 1989, Pat. No. 4,972,759, which is a continuation-in-part of Ser. No. 309,658, Feb. 13, 1989, Pat. No. 4,878,459.

[51] Int. Cl.[5] ..... F22B 37/36

[52] U.S. Cl. ..... 122/494; 138/149; 126/361; 122/13.1

[58] Field of Search ..... 138/149, 151, 168; 126/361; 122/13.1, 13.2, 14, 17, 494; 220/452; 219/311, 312

[56] References Cited

U.S. PATENT DOCUMENTS

| | | | |
|---|---|---|---|
| 1,609,858 | 12/1926 | Bohon | 126/361 |
| 2,324,181 | 7/1943 | Tulien | 138/149 |
| 2,642,851 | 6/1953 | McFerran | 122/494 |
| 3,058,860 | 10/1962 | Rutter | 138/149 |
| 3,244,388 | 4/1966 | Coffman | 138/149 |
| 4,039,098 | 8/1977 | Stilts . | |
| 4,282,279 | 8/1981 | Strickland . | |
| 4,447,377 | 5/1984 | Denton . | |
| 4,527,543 | 7/1985 | Denton . | |
| 4,660,594 | 4/1987 | Gocze | 220/452 |
| 4,736,509 | 4/1988 | Nelson . | |
| 4,744,488 | 5/1988 | Nelson . | |
| 4,749,532 | 6/1988 | Pfeffer . | |
| 4,878,459 | 11/1989 | Nelson | 122/494 |

*Primary Examiner*—Carroll B. Dority

*Attorney, Agent, or Firm*—Woodard, Emhardt, Naughton, Moriarty & McNett

[57] ABSTRACT

A thermal insulating jacket for use around pipes, conduits, tanks and related members according to the present invention includes a flexible outer covering such as a sheet of plastic or polyvinylchloride which has bonded to its surface an alternating series of insulation material strips. The insulation material strips which are bonded to the flexible outer covering include a first plurality of flexible insulation material strips and a second plurality of rigid insulation material strips. These different material strips are arranged in alternating sequence and the combination of outer covering and insulation strips is sufficiently flexible and formable so as to be wrapped into a generally cylindrical shape which may then be disposed around a pipe, conduit, tank or related member, for thermally insulating that member. The outer covering may be a one-piece member or a hinged member.

9 Claims, 16 Drawing Sheets

THERMAL INSULATION JACKET

REFERENCE TO RELATED APPLICATIONS

This is a continuation of U.S. Pat. application Ser. No. 412,923 filed Sept. 26, 1989 and now U.S. Pat. No. 4,972,759 which is a continuation-in-part of U.S Pat. application Ser. No. 309,658 filed Feb. 13, 1989 and now U.S. Pat. No. 4,878,459.

BACKGROUND OF THE INVENTION

The present invention relates in general to insulation arrangements for cylindrical members, conduits, pipes, water heaters and the like and more specifically, to the design of the outer jacket or shell for such members.

The majority of conventional commercial and residential water heaters are fabricated with an inner storage tank and an outer shell. A designed clearance space between these two generally concentric members is provided for the receipt of a suitable insulation. The guter shell is typically a singular cylindrical member which must be assembled over the tank by closely and carefully aligned axial movement of either the tank or the shell relative to the other.

One difficulty with this assembly technique is the time required due to the fact that with insulation disposed around the inner tank and a desire to compress that insulation slightly, great care must be taken with this axial sliding operating. Another concern, though related to the foregoing, is how to maximize the amount and coverage of insulation. Clearly, by increasing the thickness of insulation heat transfer losses from the tank are minimized thus reducing energy costs attributable to heating the water within the tank. However, if the thickness of insulation is too great, it will not be possible to slide the outer shell down over this insulation without significant problems of pulling and tearing the insulation to the point that the finished product is unacceptable and the insulation must be replaced and the assembly procedure repeated.

Some of the specifics as to the design of the insulation will depend upon the type of insulation used. Different design parameters exist depending upon whether the annular space between the tank and the shell is to be filled with foam insulation or an insulation blanket or both. For example, my prior, issued patents, U.S. Pat. Nos. 4,736,509 and 4,744,488 relate generally to design concepts and water heater construction concepts.

As mentioned, the annular space between the tank and the shell may also be filled by means of an insulation blanket which is draped over the tank prior to lowering the shell in place. For improved results, it is helpful to compress the insulation blanket. However, since there are difficulties in assembling the shell in a manner to achieve compression without pulling or tearing the blanket, the result is to use a relatively thin blanket of insulation so as to permit the assembly of the outer shell. Nevertheless, even with a relatively thin blanket there is some pulling and a risk of tearing and thus with insulating material such as fiberglass, it is difficult if not impossible to achieve 100% coverage.

A further option as to the insulation concept is to use a combination of a partial blanket or insulation dam or barrier and foam-in-place insulation disposed above the upper edge of the blanket or dam. My prior, co-pending applications, Ser. Nos. 177,392, 177,393 and 216,384 are examples of this combination insulation structure.

As various insulation and construction concepts for water heaters are evaluated, the speed and ease of assembly are important considerations. The appearance of the finished product is also important since attractive designs are a factor in purchasing decisions, possibly as one indicator of product quality. Since water heaters are typically mass-produced, there is a fast moving assembly line in the more efficient operations. Any design of tank, shell and insulation must keep the pace of the assembly line in mind.

Concepts and structures employed by others in the design and insulation of water heaters include the use of a bag to receive foam insulation. In one arrangement, when used with electric water heaters, the bag does not extend the full 360 degrees of the tank's circumference. Openings are left for the electrical controls. One concern with this insulation concept is the ability to get even distribution of the foam throughout the bag so that the finished product is very similar to an insulation blanket as to its uniformity and thickness. In this particular design the bag can be installed and then foamed after assembly of the shell, though again, complete coverage is a hit or miss proposition. In another arrangement, the bag may be pre-foamed and then assembled. The assembly time is though excessive with this approach and the bag even in this instance does not always foam evenly or completely thus leaving voids for heat loss leaks.

One example of the foregoing bag concept is illustrated in U.S. Pat. No. 4,527,543 which issued July 9, 1985 to Denton. In this structure a plastic envelope is wrapped entirely around the tank, or part of the tank if it is an electric water heater. After the outer shell is assembled, a foam-type insulation material (in liquid form) is injected into the envelope. A vent hole in the top cover provides an air vent during the foaming operation and also serves to provide a visual indicator for determining when the envelope is filled. Another patent to Denton, U.S. Pat. No. 4,447,377 which issued May 8, 1984, discloses a similar structure and insulation concept.

In U.S. Pat. No. 4,749,532 issued June 7, 1988 to Pfeffer there is disclosed yet another insulation concept. In Pfeffer a band of insulation is cinched to the tank such that the top and bottom edges flare outwardly beyond the location of the shell wall. In order to install the shell without tearing or pulling, a "shoe horn" type device is used to compress the outer edges inwardly as the shell is lowered into place. Thereafter the shoe horn is removed.

Although there are yet other designs where the insulation is wrapped around the inner water tank, in each such configuration the outer shell is a singular, cylindrical member which must be assembled by axial sliding motion relative to the tank. Examples of wrap-around insulation can be found in U.S. Pat. No. 4,282,279 issued Aug. 4, 1981 to Strickland and U.S. Pat. No. 4,039,098 issued Aug. 2, 1977 to Stilts. In Strickland ('279), while the art is different and possibly unrelated to the present invention, there is disclosed an insulation blanket which is designed to be wrapped around a cylindrical tank (beverage can) and the free ends are thereafter secured together. In Stilts ('098), a thermal insulation jacket is provided where the free ends are joined by strips of tape.

In the present invention as it pertains to insulation for water heaters, the singular, cylindrical outer shell is replaced with a split generally cylindrical, wrap-around shell which may be opened and closed in a hinged movement so that the axial sliding procedure of prior shell designs can be eliminated. The construction of the present invention solves many of the current problems and provides an ease and efficiency of fabrication which is not presently available. The problems as to the integrity and completeness of the insulation which is disposed between the inner tank and the outer shell do not exist and the integrity and completeness can be confirmed before the shell is closed in place around the insulation. As an alternative this embodiment may be used for pipes and conduits.

As it pertains to insulation for water heaters, the present invention contemplates an initially flat, though flexible, shell which is formed into two generally semi-cylindrical portions which are joined along one edge in a hinged fashion and the opposite free ends are secured together at the completion of the closing operation. A number of configurations are available for the hinge mechanism as well as for securing the free ends together. .An alternative is simply to provide enough flexibility in the shell material that hinging-type movement can occur without using an actual hinge. A review of the cited references reveals that prior designs have never envisioned such a shell design, even in view of the many advantages and improvements which the present invention offers. It was not until the conception of the present invention that this idea came into being. This arrangement may also be used for pipes and conduits.

As the present invention pertains to insulation arrangements or jackets for pipes and conduits of various types, it should first be understood that a variety of methods have been used over the years to thermally insulate pipes, conduits and cylindrical objects, such as the previously discussed inner tank of hot water heaters.

One such prior method includes using a narrow strip of fiberglass which is wrapped repeatedly with a slight pitch and overlap to the prior wrap for the full length of the pipe. An outer covering is used over the fiberglass and the abutting edges of the covering are taped together. An alternative method to the referenced fiberglass is to use flexible urethane but neither fiberglass nor flexible urethane is as good a thermal insulator as is rigid urethane foam.

There is thus a compromise in material selection when wrapping a pipe or conduit between the ease of use, due to the flexible properties of fiberglass and flexible urethane, and their less-efficient thermal insulation properties when compared to rigid urethane foam. There are other drawbacks to the use of fiberglass and flexible urethane beyond the less-efficient thermal insulation including a greater susceptibility to damage, such as by tearing. In order to reduce this susceptibility to tearing, the fiberglass and flexible urethane is typically covered with an outer shell or jacket. The application of this outer shell or jacket generates additional labor and material costs. It is also not feasible to wrap a sheet of rigid urethane foam around a pipe without breaking or crumbling portions of the foam.

As indicated, in order to achieve maximum thermal efficiency for a given thickness of thermal insulation, rigid urethane or polyisocyanurate foam is most often used. One common method of insulating with rigid urethane is to mold a generally cylindrical thick-walled tube with an inside diameter that corresponds closely to the outside diameter of the pipe or conduit to be insulated. The tube of insulation material is then pushed down over the pipe with a sliding action. When the pipe is already installed in a plumbing or conduit network such as in a processing plant, the generally cylindrical tube of insulation material must be split into two halves which can then be fitted around the pipe and thereafter the halves secured together by some appropriate tie or wrap or by strips of tape.

Whether used as a cylinder of rigid urethane or split into two halves, the beginning tube of insulation material is often fabricated from rectangular blocks of foam which results in tremendous waste and associated inefficiencies. For example, a block of foam which measures one foot by one foot on the end and is six feet long constitutes a foam volume of six cubic feet. Cutting a tube from the block which is one foot in outside diameter and with a three-inch inside diameter and also six feet long results in a tube volume of 4.71 cubic feet. The wasted material of approximately 1.29 cubic feet constitutes a material loss or waste of the original material block of approximately 21.5%.

Another drawback to using preformed rigid urethane in foam blocks or generally cylindrical tubes is the significant shipping costs due to the shape of the insulation. If the entire block is shipped, then the wasted material is shipped as well as the material for the resultant tube and there is not only a material inefficiency, but the inefficiency of the added shipping cost for shipping the wasted material.

Even if the tubes are cut or machined from the foam blocks prior to shipment, the cylindrical shape consumes significantly more space than that occupied by the actual tube. This inefficiency exists whether the tubes are shipped as full tubes or cut into the split halves as mentioned above.

As the present invention pertains to insulation arrangements or jackets for pipes and other conduits, it provides a flexible outer covering which has an insulation assembly laminated to it. This insulation assembly consists of alternating blocks of rigid insulating material and flexible insulating material so that it can be formed into the shape of a cylinder. Fasteners are used to secure the cylindrical shape around the pipe, conduit or other member. The design of the present invention solves the problem of shipping inefficiencies in that the sheets of material can be shipped in flat form or in blocks where none of the material is wasted. The blending of rigid urethane foam insulation material and flexible insulation material provides an acceptable compromise in overall insulation R-values. This embodiment may also be used to insulate the inner tank of a water heater or other conduits.

SUMMARY OF THE INVENTION

An insulation arrangement for generally cylindrical members for commercial and residential use according to one embodiment of the present invention comprises a generally cylindrical water tank, insulation means disposed against the outer surface of the water tank, a generally cylindrical outer shell split into two hinged portions wherein each portion includes a free end and means for securing the free ends together such that the outer shell is drawn into abutment with the insulation means when closed into its generally cylindrical shape.

The present invention according to another embodiment comprises a flexible outer covering, a plurality of flexible insulation material strips bonded to the outer covering, a plurality of rigid insulation material strips bonded to the outer covering and which are disposed in alternating sequence with the flexible insulation material strips.

One object of the present invention is to provide an improved thermal insulation jacket.

Related objects and advantages of the present invention will be apparent from the following description.

DESCRIPTION OF THE PREFERRED EMBODIMENT

Figure 1:
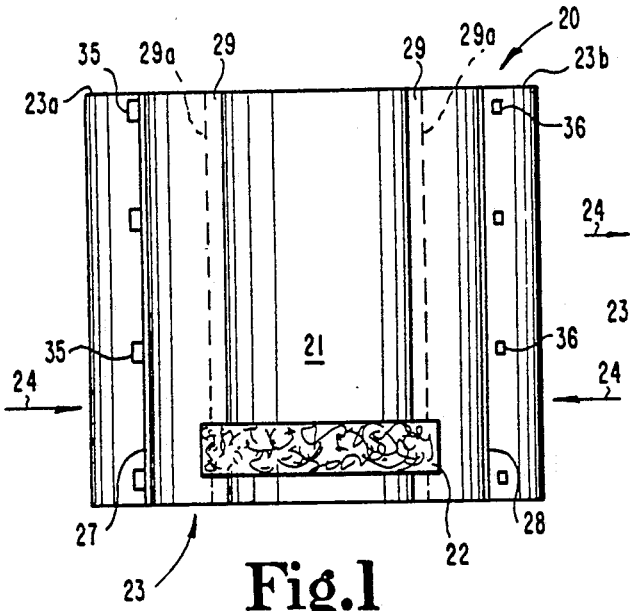
FIG. 1 is a diagrammatic front elevational view of a water heater outer shell applied around an insulated tank according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
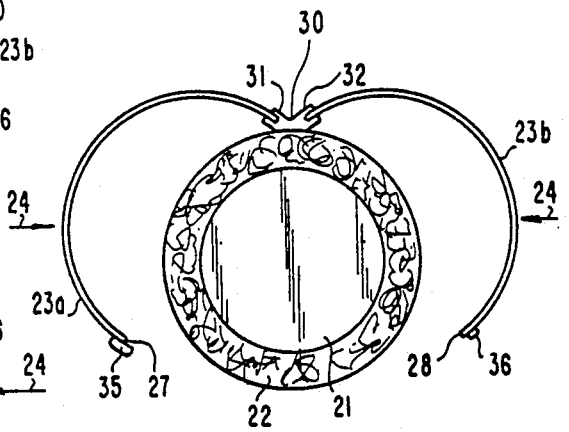
FIG. 2 is a diagrammatic top plan view of the FIG. 1 outer shell and insulated tank.

Referring to FIGS. 1 and 2 there is illustrated in diagrammatic form a partially disassembled hot water heater 20 which includes inner water tank 21, a blanket of insulation 22 which is wrapped around the exterior surface of the inner water tank, and a two-part outer shell 23 with hinged halves 23*a* and 23*b* which close together in the direction of arrows 24 in order to complete the assembly of the water heater.

In the preferred embodiment the two halves 23*a* and 23*b* of outer shell 23 are configured such as when their corresponding, axially-extending free ends 27 and 28 are hinged together so as to completely enclose or encircle tank 21 and insulation 22, the completed outer shell is of a generally cylindrical structure and is positioned relative to tank 21 in a generally concentric fashion. In this regard, a substantially uniform annular space 29 is created between the outer surface of the tank and the inner surface of the shell. It is within this annular space that the blanket of insulation 22 is disposed. Due to the opened nature of shell 23 the annular space 29 is not completely defined. Broken line 29*a* provides an indication of the outer edge of space 29 once shell 23 is closed. Although only a small section of insulation is illustrated, it is to be understood that this blanket or band of insulation could extend the full height of the inner water tank and could even be draped over the top surface of the tank.

It is also to be understood that the radial thickness of the blanket of insulation 22 is slightly greater than the radial thickness of annular space 29 such that when the two halves of outer shell 23 are hinged together so as to complete their cylindrical enclosure, the blanket of insulation will be compressed in the direction of the tank. Obviously the greater the radial thickness of the blanket of insulation relative to the size of annular space 29 the greater the degree or extent of compression required in order to close the outer shell. This compression of the blanket of insulation will occur throughout the full height of the blanket even if it is extended from top to bottom completely around the entirety of the inner water tank. Furthermore, this blanket of insulation may be secured directly to the tank or may be attached by bands or similar mechanical structures in order to hold the blanket in its desired location.

As discussed in the Background of the Invention, a number of insulation concepts are envisioned for use with the present invention and the blanket of insulation illustrated in FIG. 1 may be used in combination with a foam-in-place insulation (initially in liquid form) which is injected above blanket of insulation 22 into the annular space 29.

One advantage of the hinged outer shell design of FIG. 1 and 2 is that it eliminates the need to axially slide either the tank into the outer shell or the outer shell over the tank. As previously mentioned in the Background of the Invention, this sliding action creates the risk that the insulation will be pulled or torn or in some manner disturbed such that it does not provide the maximum insulation nor complete or adequate coverage around the tank. As mentioned, an earlier approach attempted to "shoe horn" the outer cylindrical shell down over a thickness of insulation which is radially thicker than the dimension from the tank to the shell. Some approaches have tried to use insulation which is radially compressed and then the shell put in place before that insulation can expand back outwardly. These approaches are marginal in that the excess thickness of insulation must be tightly controlled and if too much is used it will either expand back to full size too quickly or will be stretched or torn when the shell and tank axially slide together into their final assembly.

The manner or nature of joining halves 23*a* and 23*b* together is illustrated in FIG. 2 includes a hinge 30 which includes on opposite ends, receiving channels 31 and 32, which rigidly and securely attach to the ends of outer shell halves 23*a* and 23*b*, respectively. The center portion of hinge 30 has a suitable flexibility to act as a type of living hinge in order for halves 23*a* and 23*b* to be spread apart such that with the blanket of insulation first applied directly to the inner water tank's outer wall, the shell can thereafter be moved into position, the halves then closed so as to create a clamping action radially inward, around the blanket of insulation 22. As the free ends 27 and 28 are hinged or pivoted towards one another so as to complete the generally cylindrical outer shell, it is to be understood that a two-part latch mechanism is employed at a plurality of locations from top to bottom along these free ends. Each latch assembly includes a latch portion 35 adjacent free end 27 and a cooperating and engaging latch portion 36 adjacent free end 28. These two latch portions 35 and 36 are configured so as to provide a type of cam action similar to the latches on a tool box or luggage such that although there is slight resistance to the closing of the two halves due to the compression of the blanket of insulation, initial connection can be made and thereafter the mechanical advantage of the cam or levering action used to securely join halves 23*a* and 23*b* together with a tight and flush joined seam.

It is also envisioned that halves 23*a* and 23*b* can be hinged together by a conventional piano hinge, though with slightly curved flanges so as to approximate the general cylindrical curvature of the completed shell. It is also to be understood that whatever hinge mechanism is utilized that it should extend the full height of the outer shell so that the enclosing of the insulation and tank is complete. The top and bottom of the water heater 20 may be fabricated in any of the presently well known techniques.

Figure 3:
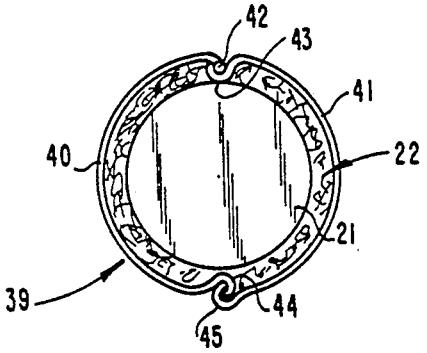
FIG. 3 is a diagrammatic top plan view of a hinged outer shell according to a typical embodiment of the present invention.

Referring to FIG. 3 an alternative hinge configuration is illustrated wherein outer shell 39 includes a first portion 40 and a second portion 41 each of which are specifically shaped and contoured at their free ends so as to provide an interlock hinge arrangement on one side and a connecting arrangement on the opposite side. In order to achieve this combination, outer shell portion 40 includes along one edge an axially extending generally cylindrical rib 42 and outer shell portion 41 includes at its adjacent and cooperating free end a part cylindrical and hollow channel 43 which extends axially the full height of outer shell portions 40 and 41. As is illustrated, rib 42 and channel 43 interfit with each other such that outer shell portions 40 and 41 can be opened and closed in a clam shell-type arrangement where rib 42 and channel 43 serve as the hinge for that opening and closing action. To enhance the security and integrity of this two-part hinge arrangement, it is possible to form channel 43 with a circumferential extent of at least 300 degrees. As a result, the opening left (approximately 60 degrees of circumference) is not adequate for rib 42 to pass through and thus the assembly of outer shell portions 40 and 41 must be done by axially sliding rib 42 down into channel 43 prior to application of the shell around tank 21 and insulation 22.

At the opposite side the other free ends of outer shell portions 40 and 41 are interlocked though in a slightly different manner. By creating a type of curved or spiral wrap at free end 44 and a complementing curved or spiral wrap at free end 45, these two ends are able to be latched together simply by compressing the outer shell portions 40 and 41 together until there is clearance for the interfit of ends 44 and 45, making that interfit and then allowing the outer shell portions to spring back into their normal cylindrical configuration as illustrated in FIG. 3. It is also to be understood that this curved and spiral interfit of free ends 44 and 45 could be used with the hinge arrangement of outer shell halves 23*a* and 23*b*. Similarly, the latch configuration in FIG. 1 could be used as part of outer shell portions 40 and 41. What is being illustrated in these first three figures is the concept and design of providing a water heater outer shell in two halves or portions which are hinged together along one end and latched or interlocked with one another along the opposite side edge. The specific design of the hinge and the specific technique used to interlock or secure together the free ends while important, are able to be satisfied in a number of different ways. Characteristics which are of interest and should be provided include a hinge design relative to the two portions of the outer shell such that once assembled into their hinged relationship can be opened sufficiently wide so as to be placed around the inner tank and layer of insulation. Only in this manner can the integrity and completeness of the insulation be preserved such that the only forces acting upon the insulation by the assembly of the shell will be radially compressive forces pushing inwardly in the direction of the tank. With the present invention there is no axial sliding required between the shell and the tank thus eliminating the earlier problems of insulation pulling and tearing.

Figure 4:
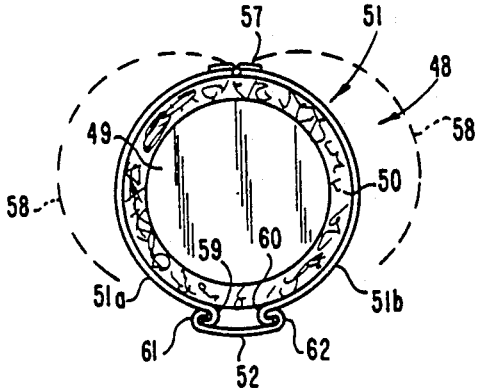
FIG. 4 is a diagrammatic top plan view of a hinged outer shell according to a typical embodiment of the present invention.
Figure 5:
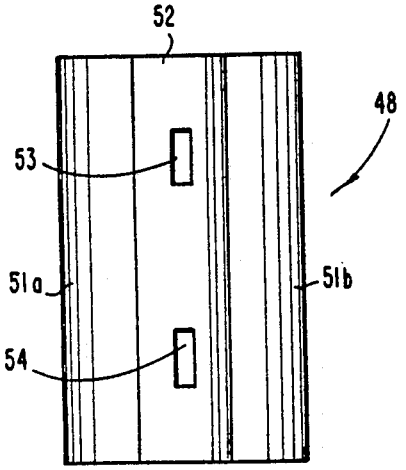
FIG. 5 is a diagrammatic front elevational view of the FIG. 4 outer shell as assembled as part of a completed water heater

Referring to FIGS. 4 and 5, a still further alternative embodiment for the present invention is illustrated. Water heater 48 includes an inner water tank 49, insulation 50 which is disposed around the water tank, a two-part outer shell 51 including first portion 51*a* and second portion 51*b* and a closing or latching panel 52 with heater control access openings 53 and 54. First and second portions 51*a* and 51*b* are hinged together by means of piano hinge 57 which is disposed on one side of the water heater and which extends axially for substantially the full height of the water heater. As is consistent with the design of the present invention, first and second portions may be hinged outwardly so as to open outer shell 51 as illustrated by broken lines 58. When the outer shell is opened in this manner by the hinged separation of its two portions, the shell may be fit around insulation 50 and thereafter the first and second portions are closed together creating slight compression in the insulation and resulting in an improved water heater design.

With regard to closing panel 52, it is to be understood that first and second portions do not create a full 360 degrees of circumference for the outer shell. Approximately 30 degrees of circumference are covered by closing panel 52 whose outer edges are each formed with a curved metal channel which is directed inwardly. In a complementing nature, the free ends 59 and 60 of the first and second portions, respectively, are formed with curved axial channels which open outwardly. As the first and second portions are hinged together in a closing manner, the first channel 61 of closing panel 52 is hooked into channel 59 and at that point is then drawn towards channel 60 at which point channel 62 of closing panel 52 is hooked into channel 60. The hooked interfit between these four channels completes the outer shell providing 360 degrees of coverage around the water heater insulation and tank and permits the hinged, two-part design of the present invention to be incorporated in a design where front panel access openings such as 53 and 54 are required.

Figure 6:
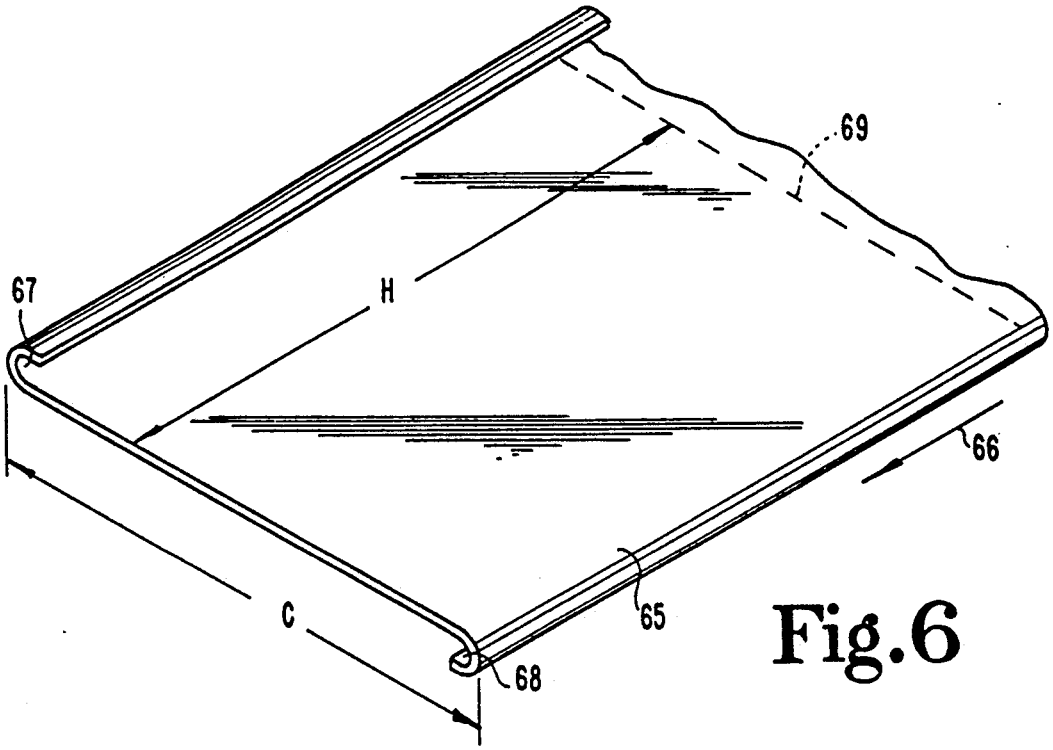
FIG. 6 is a perspective view of a formed outer shell prior to circumferential wrapping according to a typical embodiment of the present invention.
Figure 7:
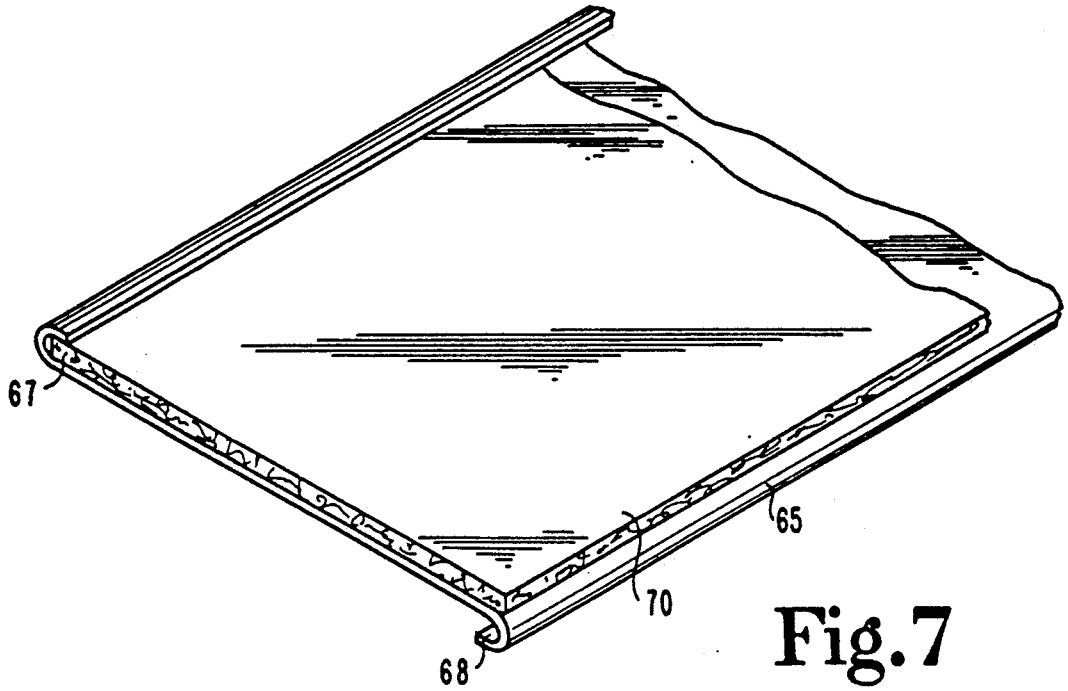
FIG. 7 is a perspective view of the FIG. 6 outer shell with insulation applied.

Referring to FIGS. 6 and 7, a still further alternative embodiment of the present invention is illustrated. In FIG. 6, outer shell skin 65 is shown as an extrusion which may be either metal or plastic and is coming from the extruding dies in the direction of arrow 66. If metal is used for outer shell skin 65 then the curved flanges defining longitudinal channels 67 and 68 may be formed in flat sheet stock coming off of a roll as part of an automated forming process, though not necessarily an extrusion. The point being illustrated and described is that it is possible to automate the process of fabricating a metal or plastic skin which will be used so as to create the outer shell for water heater construction. It is envisioned that at some point downstream in the fabrication process, the formed or extruded skin 65 will be cut to a desired length along broken line 69 and this length which is marked by the letter H represents the height of the outer shell for use in the water heater construction. Either before or after cutting the skin to the desired length (height), insulation may be applied directly to the skin as is illustrated in FIG. 7. Insulation 70 may be either poured foam insulation or sprayed-on fiberglass or cellulose insulation. Alternatively, insulation 70 may be from a roll of flexible foam or fiberglass batting and simply rolled out on the skin and cut to length equal to the length or height of the portion cut for the water heater construction. Inasmuch as it is desirable to fabricate the skin and insulation as a single assembly, some adhesive or bonding agent is applied to the surface of the skin prior to application of the insulation.

Figure 8:
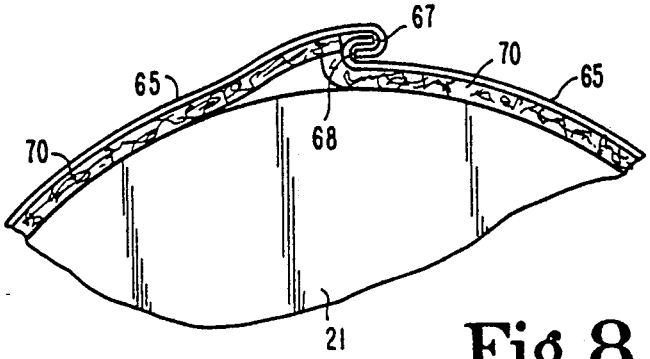
FIG. 8 is a partial diagrammatic top plan view of the FIG. insulated outer shell as wrapped around an inner tank according to the present invention.

Once the desired length is determined and a cut made along line 69, assuming that the insulation has been applied or will be applied, this panel is then curved and wrapped around the water heater tank such that curved channels 67 and 68 are drawn into interlocking engagement with each other as is illustrated in FIG. 8. The outermost edges of channels 67 and 68 are opposing free edges of the generally rectangular panel created by the cut along line 69. When the panel is flexed into a generally cylindrical shape around the inner water tank, these free edges are axially extending. It should be understood that to accomplish this interlock of channels 67 and 68 some unique shaping and contouring is required so that the finished product has an aesthetically pleasing exterior appearance. It is also to be understood that in this particular configuration, a hinge is not provided but rather the flexibility of the metal or plastic skin provides the necessary flexibility for the outer shell to begin as a substantially flat member and simply formed into a generally cylindrical configuration as it is placed around the water heater tank 21. The width of skin 65 as indicated by dimension line C equals the circumference of the outer shell when formed about the water heater tank and with channels 67 and 68 interlocked. It is also important that the insulation 70 which is applied, be applied in a manner so as to prevent any gap or void along the seam where channel 67 and 68 are interlocked.

With regard to the assembly technique, it is envisioned that flexible bands may be used in order to draw the outer shell skin 65 into its assembled generally cylindrical configuration. Thereafter, once channel 67 and 68 are interlocked, the bands are released and the assembly is completed.

Figure 9:
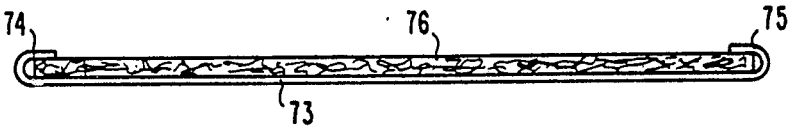
FIG. 9 is a front elevational view of an alternative outer shell designed with insulation applied.
Figure 10:
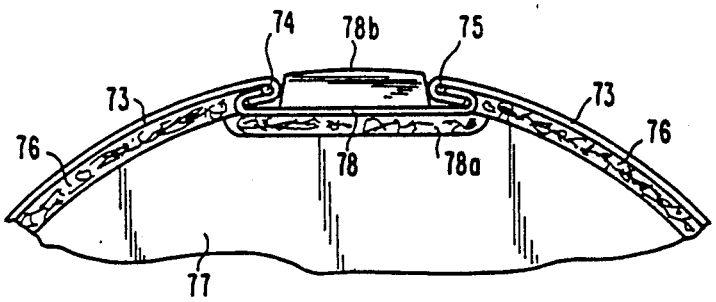
FIG. 10 is a partial diagrammatic top plan view of the FIG. 9 insulated outer shell as wrapped around an inner tank according to a typical embodiment of the present invention.

Referring to FIG. 9, an alternative skin and insulation structure is disclosed wherein skin 73 includes similarly configured free ends turned or formed to define outer curved channels 74 and 75 which are oriented in the same direction relative to each other rather than opposite directions as was previously the case with regard to skin 65. This particular configuration is intended for use with a closing panel such as panel 52 as illustrated in FIG. 4. It is also to be understood that the free end channels 74 and 75 can be turned in either direction depending on the orientation of the free end channels as part of the closing panel. Conceivably, even the free end channels 74 and 75 could be reversed from one another similar to FIG. 7 if the closing panel had its free ends alternated so as to be compatible. The assembly of outer shell skin 73 and insulation 76 to a water tank 77 and in combination with a closing control panel 78 is illustrated in FIG. 10. Panel 78 includes insulation **78*a* and filler portion 78*b* to fill in the void between the free ends of skin 73** so that the exterior of the assembly appears continuous.

Figure 11:
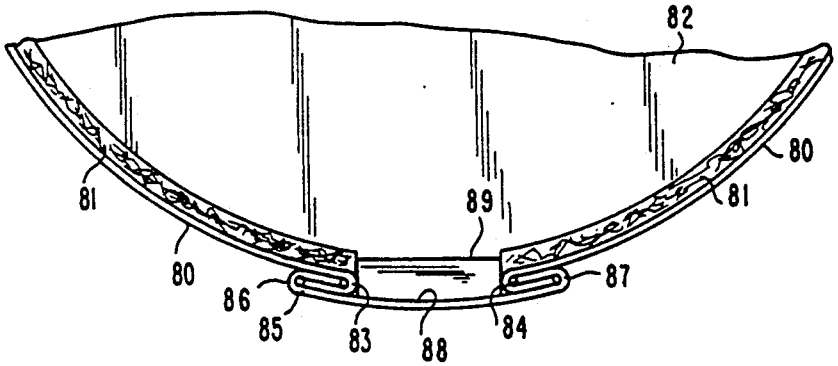
FIG. 11 is a partial diagrammatic top plan view of an alternative outer shell configuration according to a typical embodiment of the present invention.

Referring to FIG. 11, a still further alternative embodiment of the present invention is illustrated. In this arrangement, a one-piece outer shell skin 80 similar to skin 65 or skin 73 has a layer of insulation 81 applied and is wrapped around an inner water tank 82. The free ends 83 and 84 are formed with outwardly opening curved channels which are of opposite orientation to free end channels 74 and 75 and thus rather than being directed inwardly towards the tank, these channels open outwardly on the exterior surface of the outer shell. In order to complete the closing of the outer shell skin around the water tank, a heavy band or channel member 85 which extends the full height of the water heater is used to slide down over and clamp together free ends 83 and 84. Clamp 85 has its free ends 86 and 87 turned inwardly so as to create an oblong channel 88 whose width is set small enough so as to draw free ends 83 and 84 tightly toward each other. If the sizes and spacing of these various members is such that free ends 83 and 84 are not designed to abut, then insulation strip 89 is provided to fill the clearance space.

While the use of clamp or band 85 has been illustrated in FIGS. 11 with a single piece outer shell skin, this particular clamping configuration is equally suitable for use with the two-part or two-half hinged arrangement of FIG. 1. Again, while it is important to consider all of the various permutations and alternatives for the present invention, the key is the two-part or wrap-around skin whether hinged or simply sufficiently flexible to be formed as an integral member. The assembly of this skin to the inner water tank is in a circumferential or radial direction rather than axially. Consequently, insulation of greater thickness can be used with greater compression.

Figure 12:
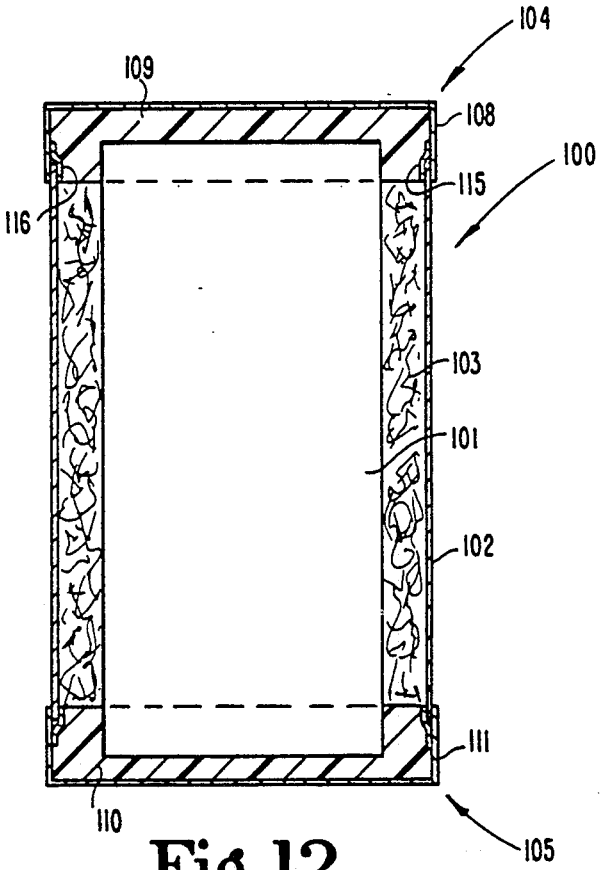
FIG. 12 is a front elevational view in full section of the insulation structure for a water heater.
Figure 12A:
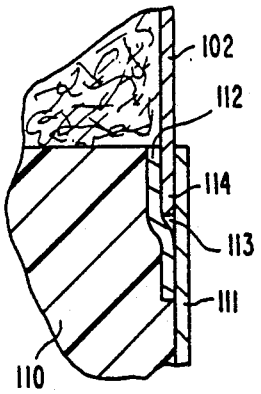
FIG. 12A is an enlarged detail from the FIG. 12 structure showing the fit between the outer shell and the bottom pan.

Referring to FIGS. 12 and 12A, additional construction details are shown relative to water heater 100. Water heater 100 includes tank 101, outer shell 102, insulation 103, top pan 104 and bottom pan 105. Top pan 104 includes a hard plastic cover 108 and a generally circular pad of insulation 109 which is recessed in its center to receive the top cylindrical end of tank 101. Since cover 108 is completely fabricated when it is set down over the top edge of shell 102, it may be fabricated of virtually any material since the fabrication options are numerous. Insulation 109 may be either a section cut from a batt or mat of fiberglass (several sections if needed for the requisite thickness) or precast to the specific size and shape desired.

It is to be understood that bottom pan 105 is configured and constructed in a manner virtually identical to top pan 104 except for possibly the depth of the generally cylindrical recess in insulation 110 which receives the lower end of tank 101. Cover 111 may also be fabricated from plastic or metal and is prefabricated with insulation 110 prior to receipt of tank 101 and outer shell 102.

As illustrated in the enlarged detail of FIG. 12A, the inner and upper edge of cover 111 is provided with a receiving lip 112 which is an offset band of material, plastic or metal, formed into an annular ring and then joined to the inside surface of cover 111. The offset configuration of lip 112 creates a generally annular channel 113 which has a radial width just slightly larger than the wall thickness of the lower edge 114 of the outer shell 102. The lower edge 114 fits snugly within channel 113 and this assembly technique is virtually duplicated for the upper edge of the outer shell which fits into channel 115 formed by the assembly of lip 116 to cover 111. When incorporating the hinged shell structure of FIG. 1, for example, or the flexible, wrap-around shell structure of FIG. 6 into the FIG. 12 assembly, channel 113 may be used as a retention means and as a guide for the shell 102 as it is shaped and moved into its desired cylindrical configuration. In the event the outer shell is formed and its free ends (edges) secured together prior to assembly of the top and bottom pans, the channels 113 and 115 serve to help hold and retain the cylindrical shape of the outer shell 102.

Figure 13:
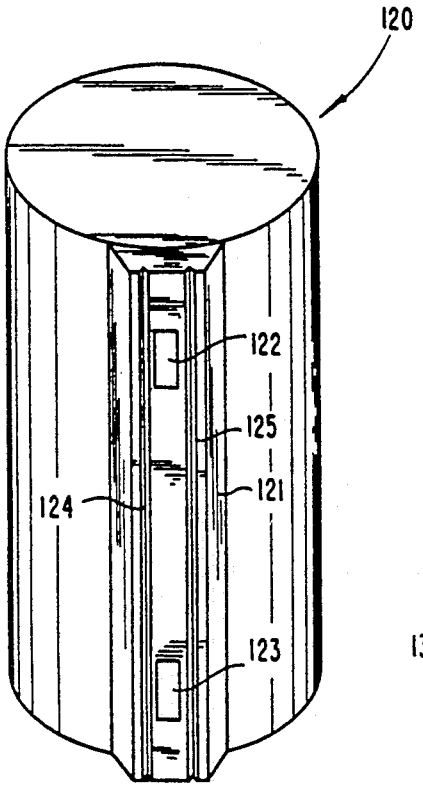
FIG. 13 is a perspective view of a water heater including a plastic control panel.
Figure 14:
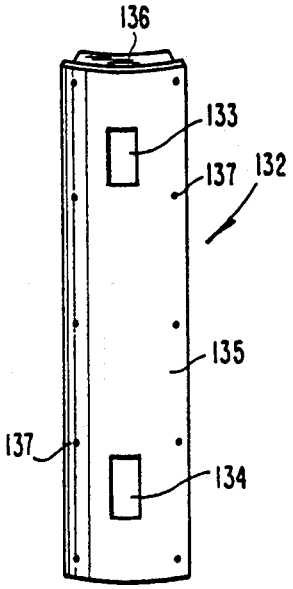
FIG. 14 is a perspective view of a cover for use in assembly to the FIG. 13 control panel.
Figure 15:
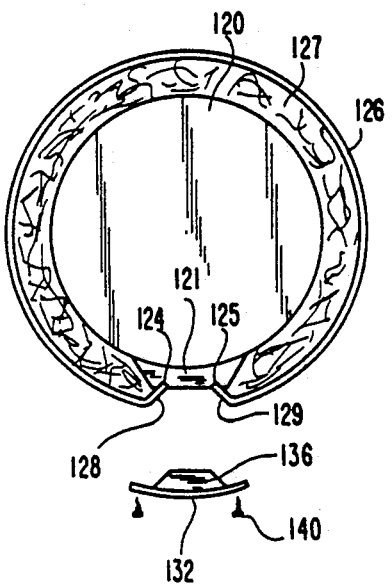
FIG. 15 is a top plan view in full section showing the assembly of the FIG. 14 cover to the FIG. 13 control panel.

Referring to FIGS. 13–15, further construction details and options of the present invention are illustrated. Water heater tank 120 includes a raised plastic panel 121 which is secured to the outer surface of the tank. Plastic panel 121 includes various controls associated with the operation and control of the water heater. Control blocks 122 and 123 represent portions of panel 121 where the controls are assembled. Panel 121 includes a pair of full-height substantially straight and parallel grooves 124 and 125. These two grooves provide a simple and convenient means to secure the free ends (edges) of the outer plastic shell 126 which is wrapped around the tank 120 and the layer of insulation 127 (see FIG. 15). Free ends 128 and 129 fit securely within grooves 124 and 125, respectively, and are anchored therein by heat-welding or staking of plastic to plastic. Alternatively, the free ends may be adhesively secured within the grooves.

Referring to FIG. 14 an appearance cover 132 is illustrated and includes access doors 133 and 134, outer skin 135, filler block 136 and a series of screw holes 137. The assembly of appearance cover 132 to outer shell 126 and plastic panel 121 is illustrated in FIG. 15. The wedge-shaped recess created by the differing thicknesses of panel 121 and insulation 127 and the angularity of free ends 128 and 129 when received by the corresponding grooves, is plugged or filled by filler block 136. The outer edges of skin 135 overlap the outer surface of shell 126 adjacent free ends 128 and 129. The skin is secured to shell 126 by the use of self-tapping screws 140 which are inserted through hole 137 and anchored into shell 126. Cover 132 covers up the assembly of the free ends to panel 121 and provides a more attractive and pleasing appearance to the overall construction of the water heater. Access door 133 is disposed over block 122 and access door 134 is disposed over block 126. Opening or removal of the doors enables the corresponding controls positioned within the blocks 122 and 123 to be accessed for operation and control of the water heater.

Figure 16:
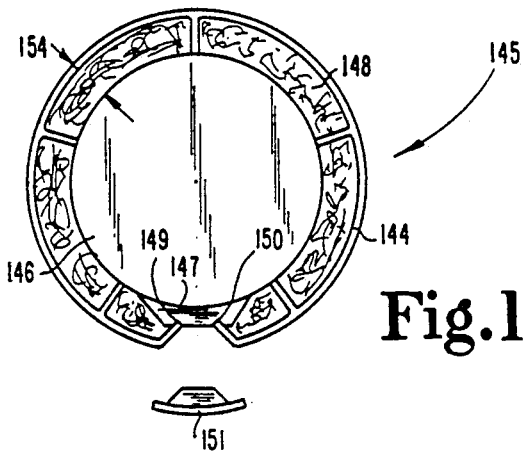
FIG. 16 is a top plan view in full section of an insulation jacket for a water heater according to a typical embodiment of the present invention.
Figure 17:
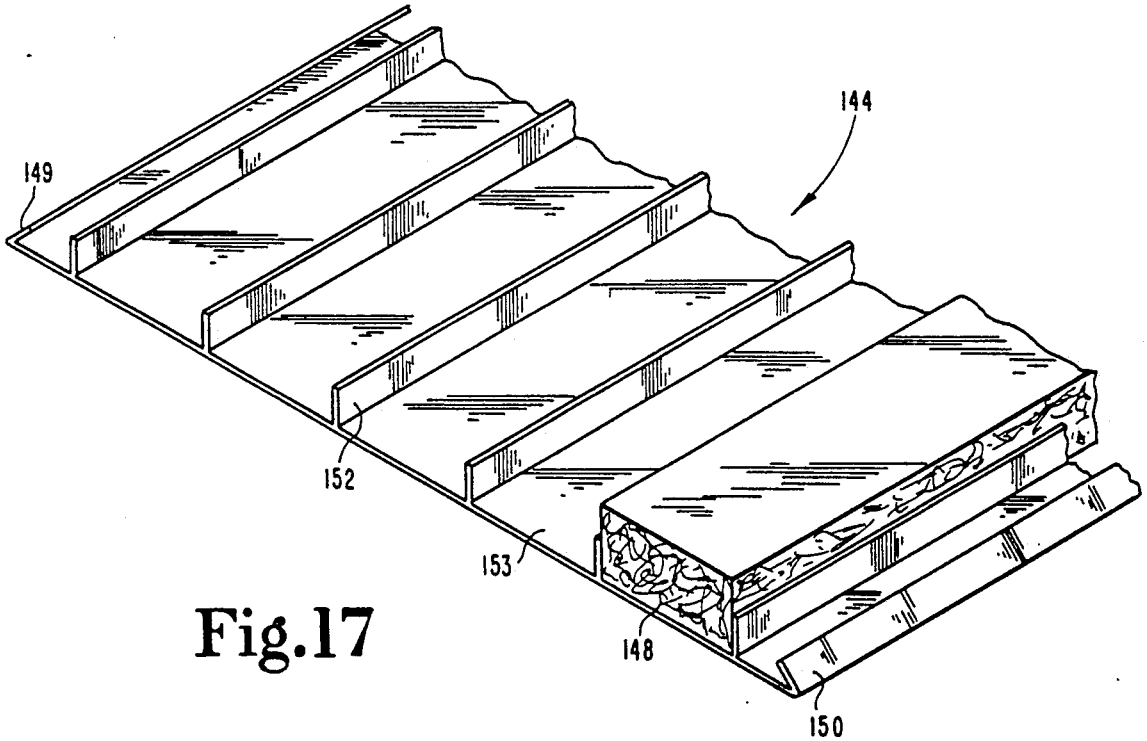
FIG. 17 is a partial perspective view of the FIG. 16 insulation blanket showing the extruded panel and one of several blocks of insulation.

Referring to FIGS. 16 and 17, an alternative construction to the outer shell is illustrated. Employing a wrap-around plastic shell 144, water heater 145 includes a tank 146, panel 147 and insulation blocks 148. The free ends (edges) 149 and 150 of shell 144 are anchored within corresponding channels in panel 147 consistent with the foregoing description relative to FIGS. 13–15. Appearance cover 151 is used to cover the assembly of the shell 144 to the panel 147 and is assembled thereto consistent with the foregoing description relative to FIGS. 13–15.

Shell 144 is an extruded plastic member formed as an integral, unitary sheet with a plurality of substantially flat and parallel spaced ribs 152. The distance or height of the ribs 152 above shell panel 153 corresponds generally to the radial distance between the outer surface of tank 146 and panel 153, or vice versa, and this annular space (arrows 154) is filled with insulation blocks 148 thereby creating an insulation blanket (shell 144). When shell 144 is flexed into a generally cylindrical shape around the inner water tank, the free ends 149 and 150 and the insulation blocks are oriented so as to extend in an axial direction. By first fabricating the plastic shell and then installing insulation blocks 148 between each rib and end blocks of insulation between the free ends 149 and 150 and their immediately-adjacent ribs, the assembly of FIG. 16 is able to be achieved. Each insulation block 148 begins with a size somewhat higher than the height of ribs 152. Then, since the insulation for insulation blocks 148 is flexible and compressible, as the shell is wrapped around the tank, the insulation blocks are slightly compressed so as to create a packed thickness of insulation between the shell and tank contributing to an improved and more efficient design. More insulation is able to be included due to the wrap-around design of the shell and its ability to compress the excess insulation into a smaller space as the free ends of the shell are secured to panel 147. As an alternative, shell 144 may be fabricated in two curved sections and then hinged together similar to what is illustrated in FIGS. 1 and 2.

Ribs 152 provide a ready-made mold for a foam-in-place insulation. All that is required is to close off the ends of the extrusion between the adjacent ribs to create a generally rectangular volume. If an increased thickness of insulation is desired (above the height of ribs 152), then a temporary extension or lip must be applied to the top of each rib for the increased thickness of the foam-in-place insulation. The ribs also significantly contribute to the strength and rigidity of the shell enabling the shell to hold or maintain its generally cylindrical shape. A further variation to the structure of FIGS. 16 and 17 is to install shell 144 around tank 146 without insulation blocks 148 installed and without any foam-in-place insulation preformed as part of shell 144 prior to assembly of the shell. In this approach, after the shell 144 is assembled and prior to installing the top pan, the enclosed hollow troughs which are thus defined by the shell panel 153, the tank 146 and each pair of adjacent ribs 152, is filled with a foam-in-place (liquid) foam insulation.

Figure 18:
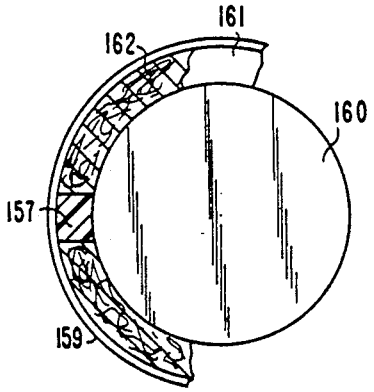
FIG. 18 is a partial top plan view in partial section of an alternative insulation blanket for a water heater according to a typical embodiment of the present invention.
Figure 19:
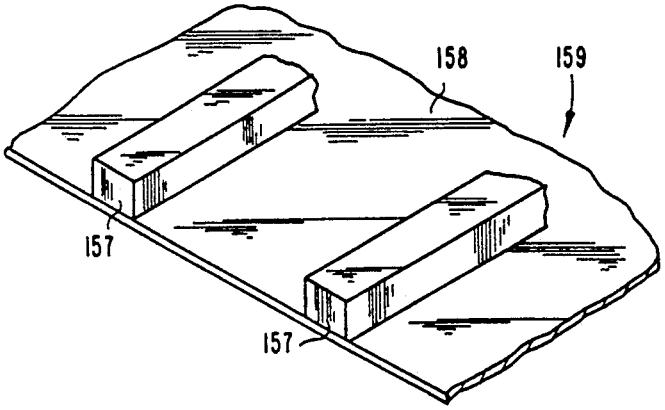
FIG. 19 is a partial perspective view of the FIG. 18 insulation blanket as unwrapped showing the base panel and two blocks of insulation.

Referring to FIGS. 18 and 19, a further variation for the present invention is illustrated. In lieu of the spaced ribs 152 of FIGS. 16 and 17, a series of spaced insulation blocks 157 are attached to panel 158 of shell 159. The height or thickness of each block 157 is determined based upon the diametral size of the tank 160 relative to the diameter of shell 159. The difference is the radial thickness of annular clearance space 161. The voids of clearance space 161 on either side of blocks 157 are filled with additional insulation, such as foam-in-Place insulation 162. In order to add to the strength and rigidity of shell 159, blocks 157 are fabricated from polystyrene or a similar rigid insulation material. This type of relatively rigid material helps the shell conform to and maintain the desired generally cylindrical shape.

In the FIG. 18 and 19 illustrations, only a portion of the total construction of shell 159 is illustrated. Omitted from these illustrations are several other blocks 157, free ends (edges) of panel 158 which are used to secure the shell to the raised control panel on the tank. It is also to be noted that blocks 157 extend virtually the entire length of panel 158. In lieu of foam-in-place insulation 162 which is applied after the shell is assembled, it is also envisioned that flexible, compressible blocks of insulation, such as fiberglass mats or batts will be assembled between blocks 157 prior to wrapping or hinging shell 159 around tank 160.

Figure 20:
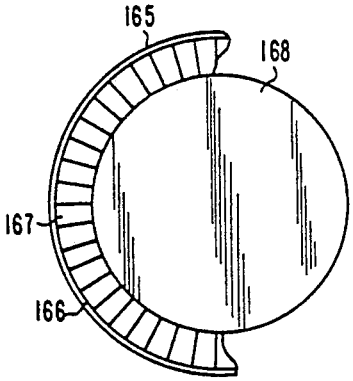
FIG. 20 is a partial top plan view of an alternative insulation blanket according to a typical embodiment of the present invention.
Figure 21:
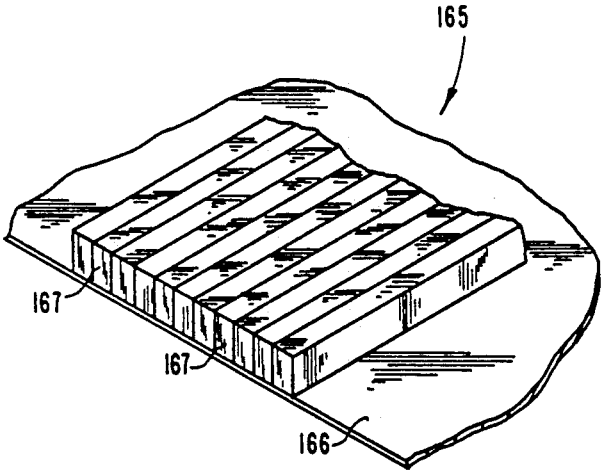
FIG. 21 is a perspective view of the FIG. 20 insulation blanket showing the panel and several insulation blocks.

Referring to FIGS. 20 and 21, a further variation of the present invention is illustrated. Shell 165 includes a plastic panel 166 and a series of insulation blocks 167 which are adhesively joined to each other and adhesively joined to panel 166. A suitable insulation for blocks 167 is fiberglass and the blocks for shell 165 are cut from a larger block. This larger block begins with a series of relatively large fiberglass panels and adhesive is applied between each pair of panels. The generally cubic mass which results has a single layer cut from the top of the cube and it is this layer which provides the adhesively bonded blocks 167 illustrated in FIGS. 20 and 21. In order to fabricate additional insulation blankets (shell 165), another single layer is cut from the top of the cube which remains after the first layer is removed. Additional cuts and removal of layers provide the type of adhesively bonded blocks 167 in multiple count for a multiple number of insulation blankets.

Consistent with all of the foregoing descriptions of the shell, the free ends and the assembly of these free ends to the plastic control panel, shell 165 is designed and assembled in a virtually identical fashion, the only difference being limited to the blocks of insulation versus earlier-disclosed approaches of ribs and spaced blocks of rigid insulation. These similarities in construction are referenced in this manner since shell 165 is only illustrated in partial form.

Shell 165 is wrapped around tank 168 as illustrated in top plan and full section form in FIG. 20. As would be expected, as panel 166 is curved into a cylindrical shape the top (inner) edges of blocks 167 which abut against tank 168 must be circumferentially compressed due to their generally straight and parallel sides and the differing circumferential sizes between the shell panel and the tank. In other words, the same length of insulation (blocks 167) is disposed into two different circumferential dimensions. Since the blocks are bonded to the panel, there is no relative motion at this interface and the only option is for the outer surface (top) of the insulation blocks 167 (the surface against the tank) to be compressed in order to fit.

As is to be understood, the generally rectangular solid form for the box 167 undergoes a differing degree of compression between the outer surface 171 which is adhesively bonded to the panel 166 and the free surface 172 which is placed in abutment against tank 168.

Figure 22:
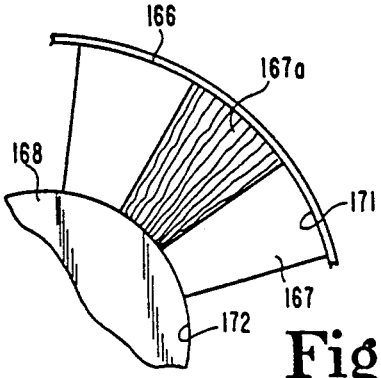
FIG. 22 is a partial top plan view in diagrammatic form showing the laminations of one block of insulation comprising part of an insulation blanket associated with a water heater.
Figure 23:
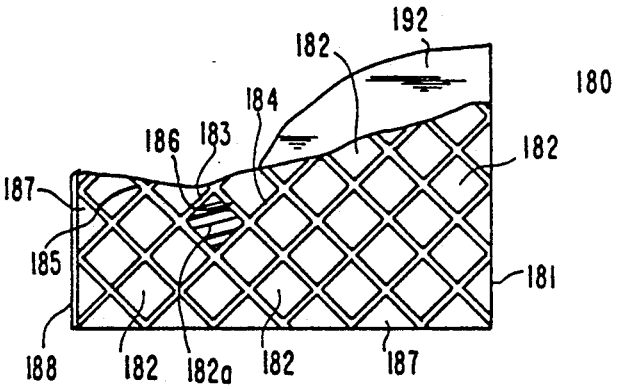
FIG. 23 is a partial top plan view of a honeycomb insulation panel according to a typical embodiment of the present invention.

Referring specifically to FIG. 22 and to insulation block 167*a*, the layering effect of fiberglass insulation is diagrammatically illustrated. There is a radiating pattern created whereby the spacing of the fiberglass layers adjacent surface 171 is farther apart than the spacing of the layers adjacent surface 172, fully consistent with the foregoing description of how the differing circumferential sizes result in differing degrees of compression between the outer surface 171 and the free opposite surface 172. The laminar nature of fiberglass insulation provides much greater compressive strength in the radial direction of the shell to the tank. This helps to provide a true cylindrical shape for the shell and should enable a thinner and thus less-costly outer shell.

Referring to FIGS. 23–27 there is illustrated a honeycombed insulation panel 180 which includes a first cover or skin 181 and a series of interconnected honeycomb pockets 182, the majority of which are each generally cubic (or a rectangular solid) and defined by two substantially parallel walls diagonally extending in a first direction and which respectively intersect with two substantially parallel walls diagonally extending in a second direction at right angles to the first direction.

Looking at one honeycomb pocket, honeycomb walls 183 and 184 extend in the first direction and honeycomb walls 185 and 186 extend in the second direction. The four-sided intersection defines pocket 182*a* which is shown filled with thermal insulation. With diagonally-extending honeycomb walls there are edge pockets 187 which are of a partial or incomplete triangular shape. These edge pockets may either be ignored or may be enclosed so that these edge pockets can receive and retain insulation. An enclosing wall 188 is drawn along the left edge of panel 180 for illustrative purposes of how such an enclosing edge wall would appear as part of panel 180. The diagonallY extending walls may be varied as to their angle, but if walls 183 and 184 do not cross walls 185 and 186 at right angles, the pockets 182 will not be cubic or a rectangular solid but rather diamond-shaped (parallelogram).

Figure 24:
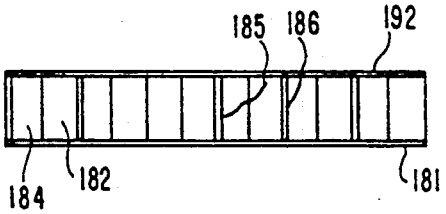
FIG. 24 is a front edge elevational view of the FIG. 23 honeycomb insulation panel.

Referring to FIG. 24, panel 180 is shown as a front elevational view with more of the top cover 192 illustrated. The edges of the walls which create the honeycomb pockets 182 are shown and each pocket is enclosed by the walls and by first cover 181 and top cover 192. If the honeycomb pockets are filled with loose, discrete insulation material, it is necessary to encase that insulation and thus the need for both top and bottom covers or skins.

An alternative to loose, discrete insulation is to place a block of fiberglass insulation in each pocket 182 in which case there is less need for top cover 192 because if the blocks of insulation are cut closely to the size of the pockets or slightly oversized, they will remain in their respective honeycomb pockets.

Figure 25:
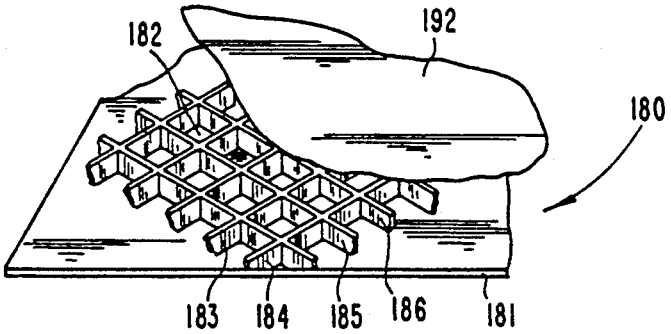
FIG. 25 is a perspective view of the FIG. 23 insulation panel with the filling insulation removed from the honeycomb.

Prior to being filled with insulation, the honeycomb walls have the appearance of FIG. 25 wherein skin 181, top cover 192, walls 183 and 184 and walls 185 and 186 are all illustrated. Although only a small portion of panel 180 is illustrated and although none of the honeycomb pockets are filled with insulation, FIG. 25 provides possibly the best view of the honeycomb configuration of panel 180. The honeycomb walls such as walls 183–186 may begin as substantially flat panels which are slotted half-way with the slotting reversed from top to bottom so that the differently directed walls can interlock with each other by mutual receipt within the slots. Alternatively, the entire honeycomb may be molded as a single, integral member. It is also envisioned that the criss-crossing and interlocked arrangement of honeycomb walls can be used as a pattern or die for a mat or batt of fiberglass insulation in order to size and cut the individual insulation blocks which are to be placed into pockets 182 so that these blocks will have a precisely matching contour.

Figure 26:
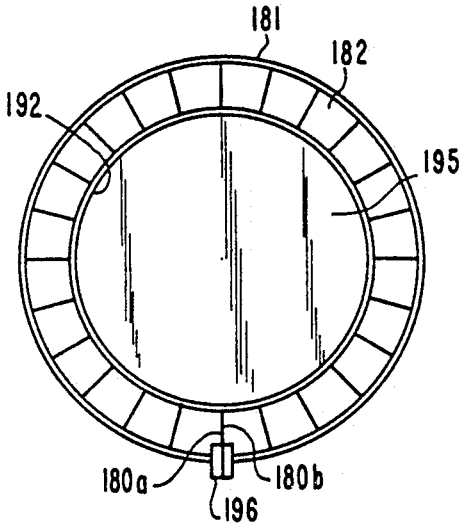
FIG. 26 is a top plan view in full section and diagrammatic form representing the complete FIG. 23 panel as wrapped around an inner tank.

It is important for the first cover (skin) 181 to be relatively flexible though stiff enough and strong enough to both support the honeycomb structure and provide a suitable outer shell for a water heater construction. As illustrated in FIG. 26, panel 180 with both covers 181 and 192 is wrapped around an inner tank 195. In accordance with the hinged and wrap-around constructions which are typical of FIGS. 1, 2, 7, 16, 18 and 20 herein, panel 180 is assembled to inner tank 195 for a finished water heater construction. In the illustrated arrangement clasp 196 joins together the outer free ends (edges) 180*a* and 180*b* of panel 180 in order to conform the otherwise substantially flat panel into a cylindrical sleeve.

The height or thickness of the honeycomb walls (i.e., the depth of each honeycomb pocket) will vary depending on the acceptable outside diameter size for the water heater and the amount of insulation desired. Since these honeycomb pockets are flexed into a cylindrical shape, the specific material must be considered relative to the height and wall thickness in order to provide the necessary flexibility for wrapping around the inner tank.

Figure 27:
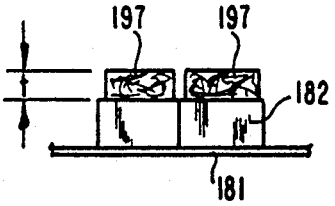
FIG. 27 is a diagrammatic front elevational view of one insulation option for the honeycomb of the FIG. 23 panel.

A still further embodiment related to the use of a honeycomb network is illustrated in FIG. 27 wherein top cover 192 is omitted and the various blocks 197 (plugs) of fiberglass insulation are cut into the peripheral shape of the corresponding pockets, but each block has a height which is noticeably higher than the upper edge of the honeycomb pocket. As the panel of FIG. 27 is formed around the inner tank (such as tank 195) into a cylindrical shell and the latch 196 is closed and locked, it is intended for the fiberglass blocks to be compressed thereby increasing the amount of insulation which is disposed around the tank. If the honeycomb walls are sized to fit up against the outer surface of the inner tank 195, then the increased height portion (t) of each block 197 of insulation which extends above the honeycomb pocket by dimension "t" is compressed completely down into its corresponding honeycomb pocket as the panel is locked around the inner tank and secured thereto by the clasp.

Figure 28:
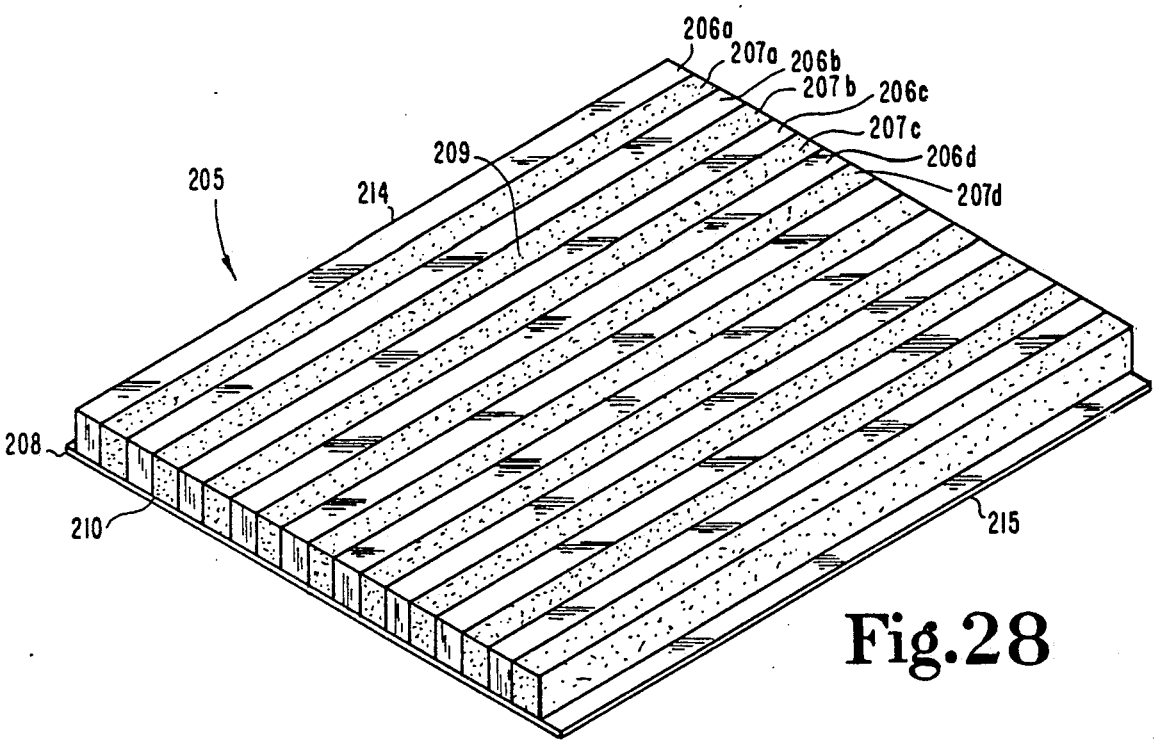
FIG. 28 is a diagrammatic perspective view of an insulation sheet including insulation strips and a flexible out covering according to a typical embodiment of the present invention.
Figure 29:
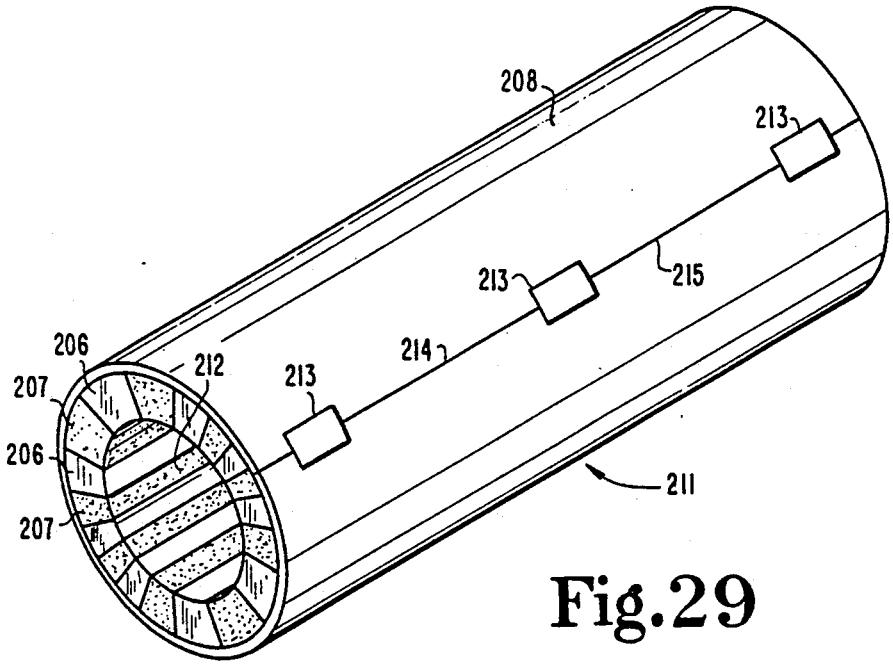
FIG. 29 is a diagrammatic perspective view of the FIG. 28 sheet as wrapped into a cylindrical hollow tube configuration according to the present invention.

Referring to FIGS. 28 and 29, there is illustrated a laminated insulation assembly 205 which is constructed of an alternating series of insulation material strips comprising strips 206*a*, 206*b*, 206*c*, 206*d*, etc., of rigid insulation material and strips 207*a*, 207*b*, 207*c*, 207*d*, etc., of flexible insulation material. While the width and thickness of strips 206 and 207 of material may vary as well as the specific materials which are used for these two strips, it is important for the thickness of strips 206 and 207 to be the same so that when formed into a tube, a smooth inside cylindrical diameter is created (see FIG. 29).

Strips 206 and 207 are securely joined to an outer flexible covering or skin which is relatively thin compared to the thickness of strips 206 and 207. This combination creates a sheet of insulation material which may then be formed about various objects in order to provide thermal insulation. Strips 206 and 207 are joined to skin 208 by means of an adhesive layer which is compatible with the materials selected for strips 206 and 207 and for skin 208. Since the lateral cross-section of each strip 206 and 207 is substantially rectangular (including square as one specific shape of rectangle) the forming of assembly 205 into a tube forces upper surface 209 to compress into a shorter length (inside diameter) than that of surface 210 which is bonded to skin 208. As a consequence of these lengths/diameter differences, it is important that strips 206*a–d*, etc. be compressible in a flexible and resilient fashion. Since strips 207*a–d*, etc. are rigid foam insulation material strips, they are not regarded as flexible or resilient, at least not to the same degree as strips 206, and thus strips 207 will retain their generally rectangular lateral cross-sectional shape when formed into the tubular configuration which is illustrated.

The consequence of this arrangement of strips and the selection of material results in the configuration of tube 211 with center aperture 212 which is cylindrical. The tape strips 213 are used to secure the abutting edges 214 and 215 together. This resulting shape can be applied around a pipe, conduit, or similar cylindrical object whose size is close to that of aperture 212. It is also to be understood that the length of assembly 205 may be set at any desired dimension and either sized to the specific pipe or pipe section length or fabricated in an oversized length and thereafter cut to the desired length. It is also to be understood that tube 211 may be slid over a pipe in its assembled tubular form or wrapped around a pipe prior to joining edges 214 and 215 together. A larger version of assembly 205 may be used as an outer shell for an inner water tank.

One advantage of this invention as embodied in the construction of insulation assembly 205 is that the sheets of alternating material strips as bonded to skin 208 can be shipped in flat form. This solves the problem of shape inefficiencies in shipping and results in important savings in fuel and labor.

While the insulating value of tube 211 could be slightly lower than a fabricated or machined tube out of rigid urethane foam with the same wall thickness, the design of tube 211 eliminates the huge waste associated with fabricated rigid foam cylindrical shapes. Reduction of such waste reduces the capacity strain on landfills and helps to reduce the amount of fluorocarbon blowing agent used in rigid urethane foam thus benefitting the ozone layer. It should also be understood that to increase the R-value, the strips 206 and 207 could be increased in thickness and the surface area of assembly 205 increased so as to create the same inside diameter size for the pipe, conduit or tank which is wrapped by this insulation sheet. Although the outside diameter would thus increase, in those applications where size constraints are not significant, it is possible to substantially increase the R-value of this insulation sheet still in accordance with the present invention.

Figure 30:
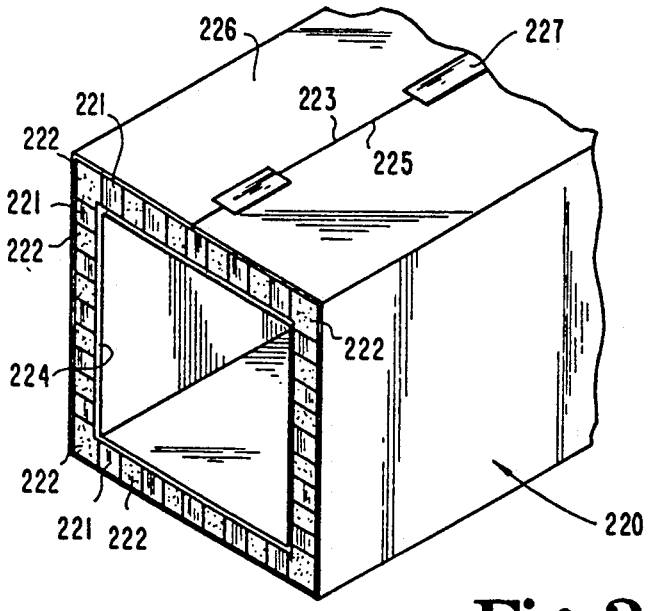
FIG. 30 is a partial diagrammatic perspective view of an insulation sheet according to the present invention as wrapped around a generally rectangular conduit.

Referring to FIG. 30, another insulating apPlication is illustrated for assembly 205 or at least a similar construction to that of the sheet of assembly 205, only larger in surface area so that it can be used to wrap a rectangular shaPe such as a heating or air-conditioning duct. In the FIG. 30 embodiment, insulation assembly 220 which as mentioned is virtually identical in construction to assembly 205 includes an alternating series of insulation strips comprising rigid insulation strips 221, and flexible insulation striPs 222. The key is to size the width of the strips and the starting position of edge 223 based on the size of the conduit 224 so that when edge 225 abuts edge 223 and there is a flexible insulation strip positioned at each corner of the duct. Edges 223 and 225 of outer skin 226 are secured together in abutment by tape strips 227. As should be understood, there are a variety of other ways to secure the gater skin around the duct and in addition to the tape strips 227 as illustrated, an encircling tie or wrap could be used as a band around the outer skin tightly cinched to hold it in position and shape.

Figure 31:
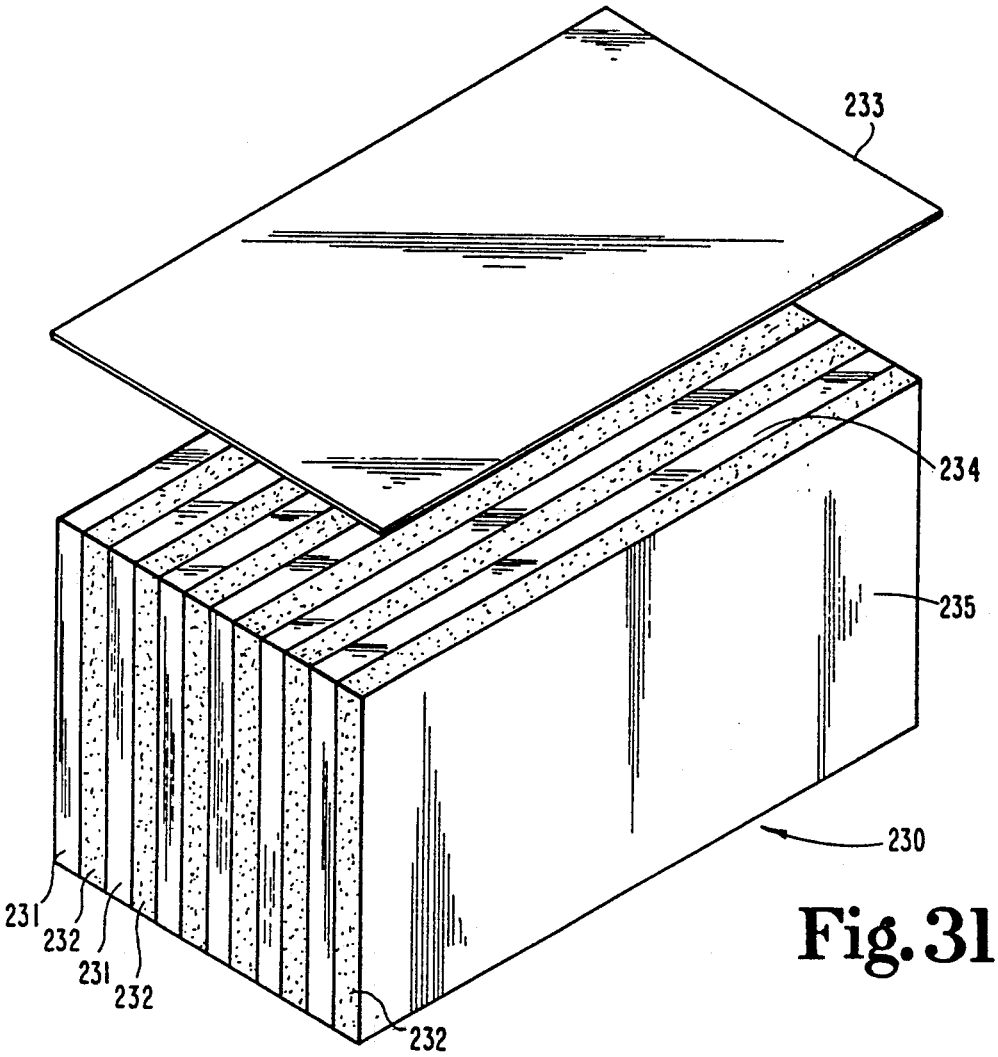
FIG. 31 is a diagrammatic illustration of the starting insulation material block used to create the FIG. 28 insulation sheet.

Referring to FIG. 31, there is illustrated a starting structure 230 which is used to fabricate insulation assemblies 205 and 220. Structure 230 includes an alternating series of insulation sheets comprising rigid insulation material sheets 231 and flexible insulation material sheets 232 which are laminated together into the block form illustrated. The next step in the fabrication process is to bond skin 233 as a covering to the top surface 234 of structure 230. Since skin 233 is securely bonded to the top exposed edge of each of the insulation sheets, any between-sheet bonding can be minimal. For the initial laminating of sheets 231 and 232 into the block structure 230, it is only necessary to maintain that configuration until the skin is bonded to the top surface. The final step is to cut horizontally through the structure 230 on a cutting plane which is substantially parallel to the geometric plane of skin 233. The cutting or saw line 235 is set at the necessary separation from skin 233 for the desired thickness of insulation material for the first insulation sheet. The end strips cut from each sheet 231 and 232 correspond to strips 206 and 207 and to strips 221 and 222 of the earlier illustrations. The bonding of additional skins and additional horizontal cuts are made in order to create additional insulation sheets.

Figure 32:
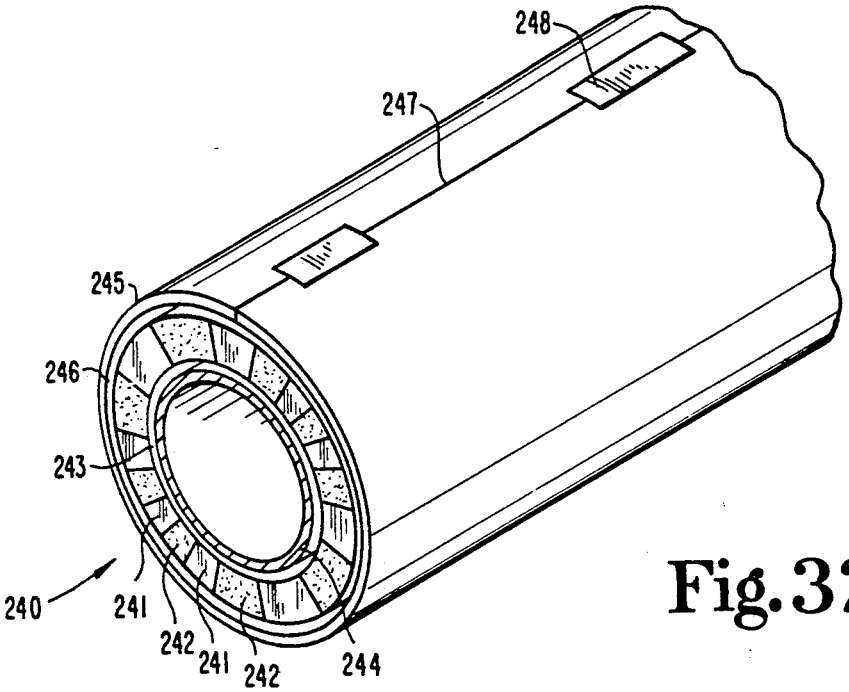
FIG. 32 is a diagrammatic perspective view of another insulation sheet as wrapped around a cylindrical conduit according to a typical embodiment of the present invention.

Referring to FIG. 32, there is illustrated another embodiment of the present invention as designed to insulate pipe, conduit and related shapes. Assembly 240 includes an alternating series of rigid insulation material strips 241 and flexible insulation material strips 242. In lieu of the exposed top surface of each strip defining a central cylindrical aperture, a layer 243 of flexible insulation material is used so that the insulation material 240 is able to fit snugly to the inner cylindrical object 244 which in the illustrated embodiment is a pipe. The flexible and resilient nature of this inner layer provides a snug fit against the pipe and fills or covers any irregularities or unevenness in the outer surface of the pipe as well as any joints or connections between pipe sections.

The outer shell or skin for assembly 240 includes an outer layer 245 of flexible PVC material and an outer layer 246 of flexible insulation material. This inner layer 246 is helpful in those applications where the strips of rigid insulation material do not readily conform themselves to the desired cylindrical tube shape. Any out-of-round conditions will be masked by the flexible and resilient nature of layer 246 so that layer 245 can be drawn into abutment at seam 247 and secured by tape 248 or other bands or ties in order to create the desired cylindrical tube shape.

Figure 33:
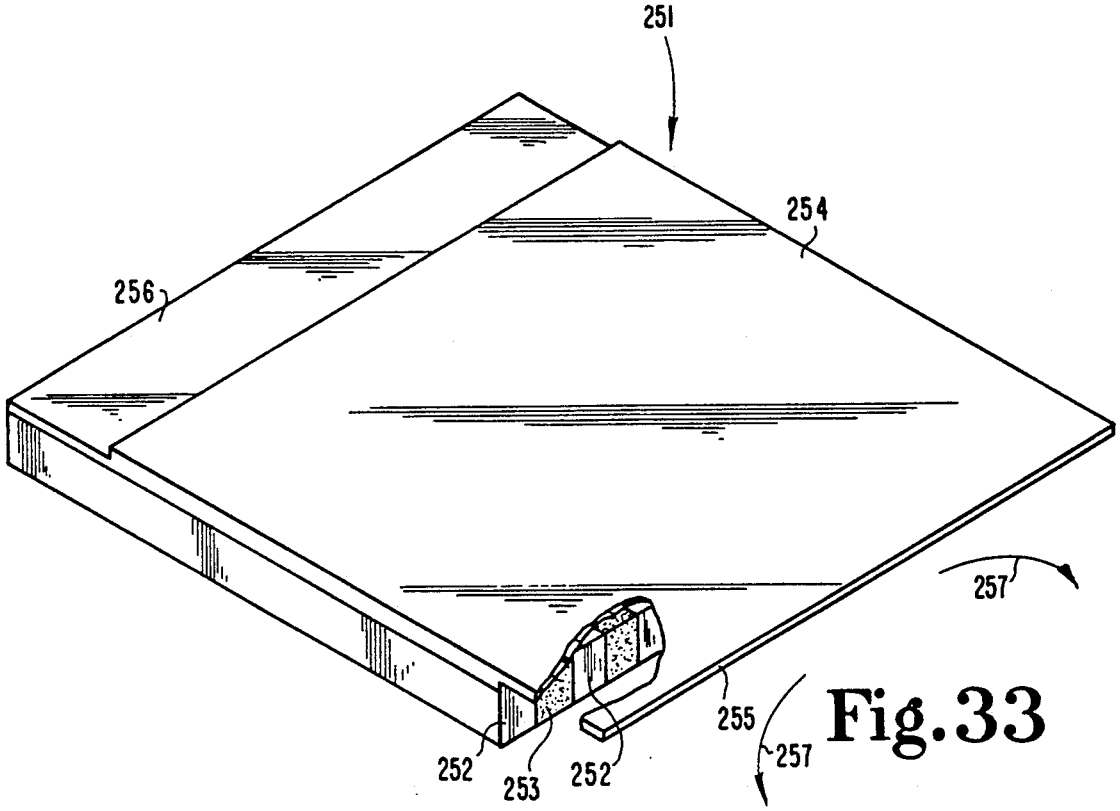
FIG. 33 is a diagrammatic perspective view of an alternative configuration for the FIG. 28 insulation sheet.
Figure 34:
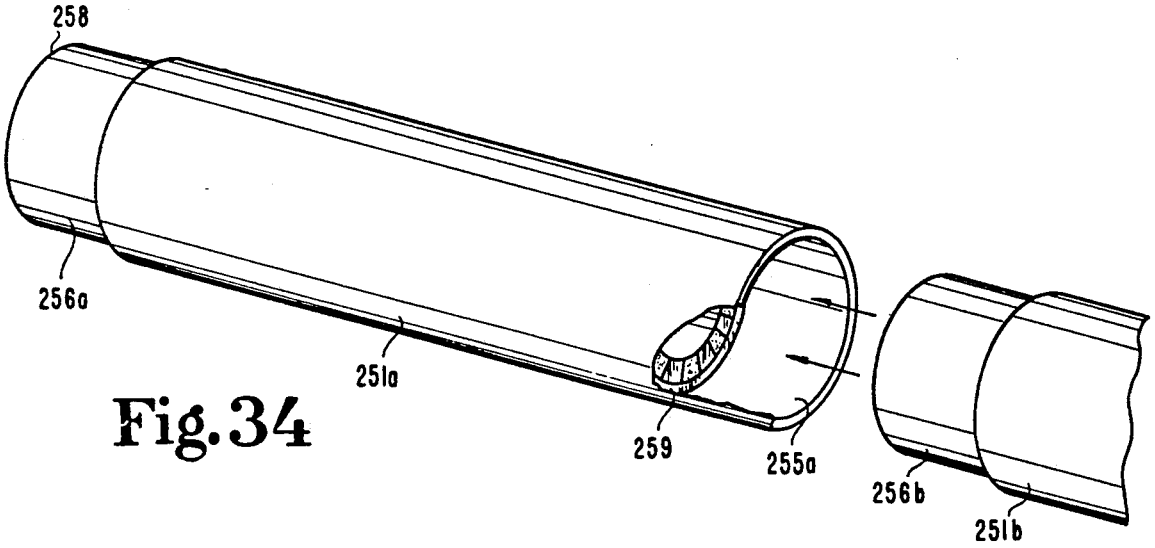
FIG. 34 is a diagrammatic perspective view of the FIG. 33 sheet of insulation material formed into a cylindrical tube for mating with an adjacent tube according to the present invention.

Referring to FIGS. 33 and 34, there is illustrated an assembly method for the present invention whereby tube sections can be telescoped together. This method begins with the fabrication of insulation assembly 251 consisting of rigid insulation strips 252 and flexible insulation strips 253 which are in an alternating pattern typical of insulation assemblies 205, 220 and 240 and of structure 230. The difference though is that in FIG. 33, the bonded outer skin 254 is machined or molded or cast with half thick flanges 255 and 256 on each end of skin 254. As illustrated, flange 255 is undercut and extends beyond the ends of the alternating series of insulation strips. At this particular end of assembly 251, the full thickness of the skin begins along a line which is substantially coincident with the ends of the insulation strips. On the opposite end of assembly 251, flange 256 is cut on the opposite side of skin 254 in order to create its half-thick dimension and the strips of insulation material on this end extend to the outer edge of flange 256. Arrows 257 indicate the direction of forming or wrapping of assembly 251 in order to create the tubular shape of FIG. 34.

Referring to FIG. 34, assembly 251 is formed into a tubular section 251*a* with flange 255 formed into a counterbore 255*a* and flange 256 is formed into recessed diameter tube portion 256*a*. Based upon the length and positioning of strips 252 and 253 relative to skin 254 as illustrated in FIG. 33, it should be understood that when formed into tubular section 251, these insulation strips extend from end 258 to the interface edge 259 of counterbore 255*a*.

Also illustrated in FIG. 34 in an exploded view manner, is a second tubular section 251*b* whose reduced diameter tube portion 256*b* is oriented in alignment with the counterbore 255*a* of the first section. The outside diameter of portion 256*b* is sized to fit snugly within the counterbore 255*a*. This assembly pattern of male (256) and female (255) fittings can thus be repeated section after section for the full length of the pipe or conduit. In this manner, the strips of insulation material in each section will abut the strips of insulation material in the joined sections so long as the strip lengths are as illustrated in FIG. 33. If these insulation material strip lengths are reduced, there will be some gap between adjacent strips of insulation material from one section to another.

In the preferred embodiments of FIGS. 28–34, the rigid insulation strips are fabricated out of rigid urethane foam or polyisocyanurate foam having a density in the range of 1.0 to 3.0 pounds per cubic foot. The flexible insulation strips are fabricated out of fiberglass with a density in the range of 1.0 to 2.5 pounds per cubic foot. While other rigid and flexible insulation material combinations may be used in practicing this invention, it is believed that the combination of rigid urethane foam and flexible fiberglass provides one of the best cost-to-performance ratios. This particular combination also provides a thermal insulation performance or efficiency which is nearly as good as molded or fabricated urethane foam and is better than molded fiberglass. Even though the foregoing are the preferred materials, there are other material combinations which may be utilized in practicing this invention, some of which include the following:

(a) rigid fiberglass combined with either flexible fiberglass or flexible urethane foam;

(b) rigid urethane foam combined with either flexible urethane foam or flexible ceramic fiber material;

(c) rigid mineral fiber material combined with flexible ceramic fiber material; and (d) foam glass combined with flexible ceramic fiber material.

Figure 35:
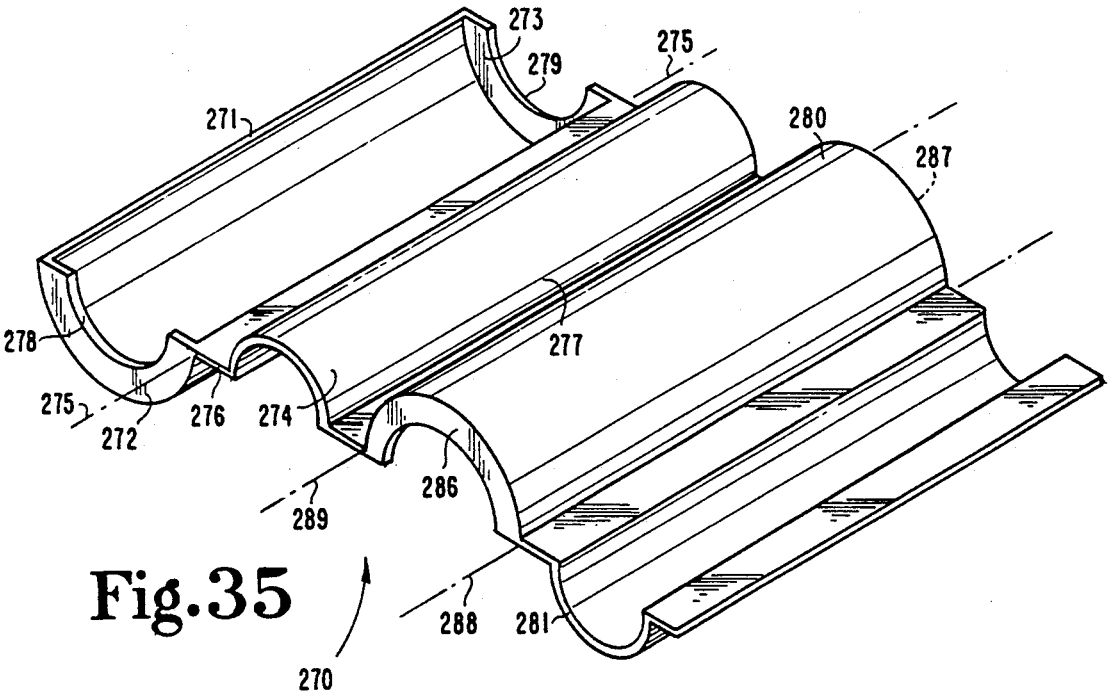
FIG. 35 is a diagrammatic perspective view of a hinged clam shell arrangement for creating a generally cylindrical insulation tube according to a typical embodiment of the present invention.

Referring to FIG. 35, there is another embodiment of the present invention suitable for creating a hollow, generally cylindrical tube of insulation material. The finished tube assembly 270 begins as a series of sections which are hinged together (FIG. 35) and can be filled with insulation material and then arranged into the thick-walled tubular shape of FIG. 38.

Figure 36:
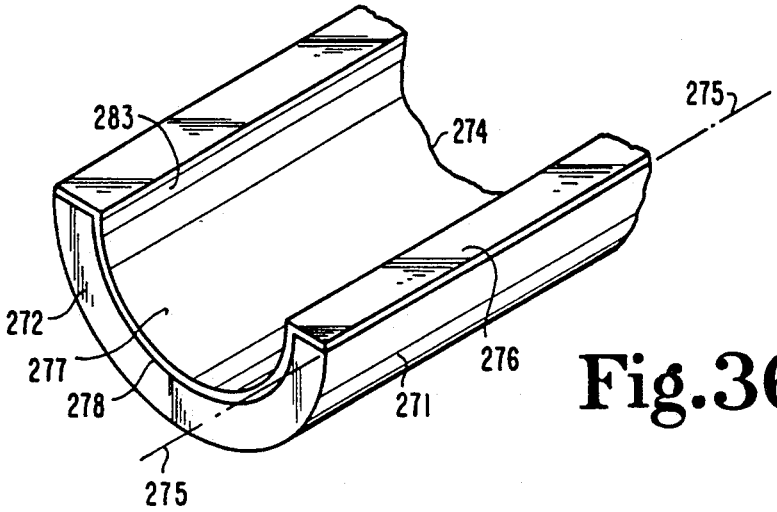
FIG. 36 is a partial perspective view of one clam shell half of the FIG. 35 arrangement with the inside and outside diameter sections closed together.

Section 271 is a vacuum-formed, semi-cylindrical shell which is open at the center of each end and the center opening is bounded at each end by semi-annular lips 272 and 273. Section 274 is a vacuum-formed semi-cylindrical shell which is integrally connected to section 271. The connecting edges between sections 274 and 271 along line 275 constitutes a thinner membrane of material creating a type of living hinge so that section 271 and 274 may be hinged or closed together in order to create a clam shell half. The width of flange 276 is equal to the radial width of lips 272 and 273 and the outer curvature of center portions 277 is virtually the same as lip edges 278 and 279. Ignoring sections 280 and 281 for now, the hinged assembly of sections 271 and 274 is illustrated in FIG. 36. In order to provide clarification as to the matching shapes and fit of these two sections, a cross-sectional view of this assembly is illustrated in FIG. 37.

Figure 37:
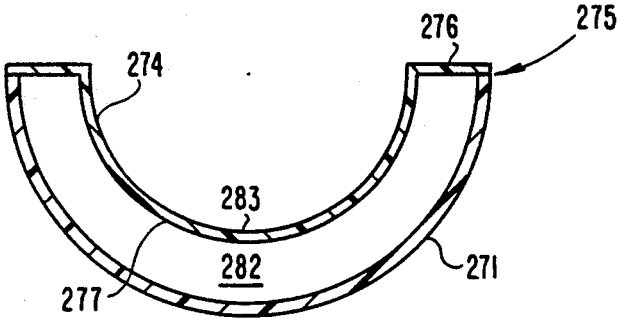
FIG. 37 is a front elevational view in full section of the FIG. 36 clam shell half assembly.

As can be seen from FIG. 37, a hollow interior space 282 is defined by the assembly of sections 271 and 274 and this interior space is completely enclosed. Further, semi-cylindrical surface 283 is sized to fit the semi-cylindrical size of the pipe, tank, conduit or similar object that assembly 270 is designed to fit around and thermally insulate. It is this interior hollow space that is filled with thermal insulation such as fiberglass or other loose fill insulation or a liquid foam-in-place urethane material. In the FIGS. 35–37 arrangement the space 282 is insulated by first partially filling section 271 with loose fill insulation. When section 274 is closed into position the loose fill insulation is moved or shifted in order to fill space 282 which is created by the closing of section 274. With liquid foam insulation material, this can either be poured into section 271 and thereafter promptly close section 274 or this liquid foam insulation may be introduced by way of a small opening in either section 271 or 274 after they are hinged closed so as to define hollow interior space 282.

Now considering sections 280 and 281 (see FIG. 35), these have a configuration in relationship which is virtually identical to that of sections 271 an 274, respectivelY. Section 280 is a vacuum-formed, semi-cylindrical shell which is open at the center of each end and the center opening at each end is bounded by semi-annular lips 286 and 287. Section 281 is a vacuum-formed, semi-cylindrical shell which is integrally connected to section 280 along line 288. Section 274 is integrally connected to section 280 along line 289. Reference to lines 2-88 and 289 are intended to identify a thinner membrane of material connecting these sections together in a manner such that these membranes of material constitute a type of living hinge. When sections 280 and 281 are closed together, they will have virtually the same or identical appearance as sections 271 and 274 as illustrated in FIG. 37. Thus there will be a second hollow interior cavity to be filled with loose fill or foam-in-place insulation.

Figure 38:
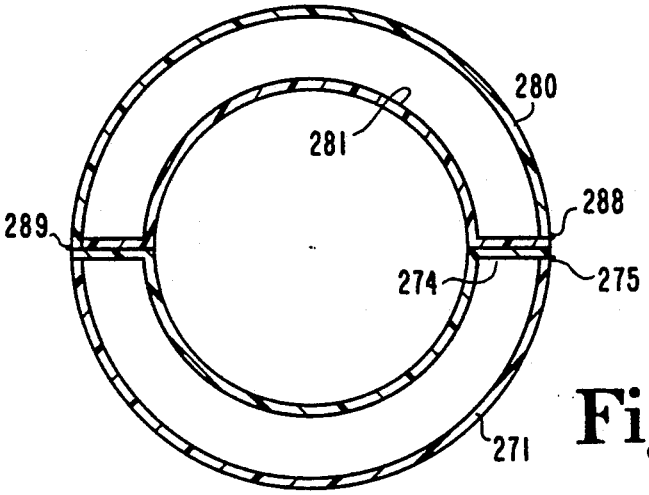
FIG. 38 is a front elevational view in full section of the four sections of FIG. 35 hinged together so as to create a hollow generally cylindrical tube according to the present invention.

The combination of all four sections hinged closed and hinged together is illustrated in full section in FIG. 38. Hinge locations are identified by reference numerals 275, 288 and 289. Sections 271 and 274 are hinged together by an integral living hinge at 275 and sections 280 an 281 are hinged in the same manner by an integral living hinge at 288. The final connection is between section 280 and 274 by means of in integral living hinge along line 289. In order to create this last integral living hinge, lip 290 preferably fits within its section 280 as illustrated. Although the living hinge connecting section 280 with section 274 could be increased in size and arranged so as to span the outer edge of section 281, the more efficient design is to shorten the flange of section 281 so that it fits within section 280 thereby allowing section 280 to hinge directly with section 274.

The integral connection of the four sections and their hinged relationship to each other enables, the hollow interior space 282 and the corresponding hollow interior space created by sections 280 and 281 to be filled with thermal insulation material. Once these two clam shell halves are filled with insulation material, they may be closed together thereby creating an annular tube of insulation material about the pipe, tank, conduit or other member to be insulated. Fasteners such as clasps or tape or straps may be used to secure the hinged sections into the final tube shape of FIG. 38. Consistent with the hinged sections and insulation-filled hollow tube of FIGS. 35–38, there are other arrangements of the four sections which can be hinged in a manner so as to create the insulation-filled tube of the present invention. It is important to understand from the sequential illustrations of FIGS. 35–38 that the hollow interior space of each tubular clam shell half may actually be over-filled with loose thermal insulation material wherein the overfill actually pertains to that material which is disposed in sections 271 and 280. By over-filling these cylindrical sections with loose fill insulation, a packing or compressive step must occur when the enclosing sections 274 and 281, respectively, are hinged into the closed position so as to define the semi-cylindrical enclosed halves. By over-filling section 271 and 280 and then packing that excess insulation greater thermal insulation values are able to be achieved thereby enhancing the overall thermal efficiency of the finished product. Further, this concept of overfill with loose fill insulation material is applicable to all other embodiments of this invention where one section or semi-cylindrical member is filled with insulation and an enclosing member is clamped or hinged into position relative to that first member.

Figure 39A:
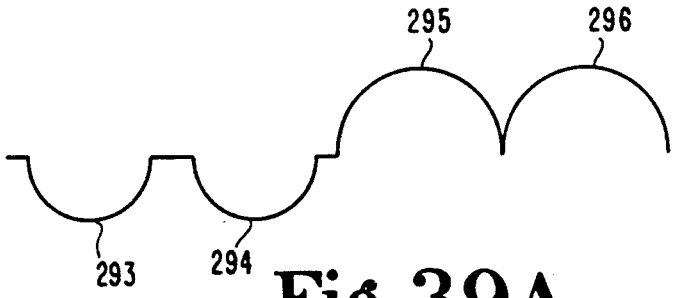
FIGS. 39A, 39B and 39C diagrammatically represent an assembly sequence of four sections hinged together and closed in a particular sequence to create a generally cylindrical, insulation tube for placement around a conduit in accordance with the present invention.
Figure 39B:
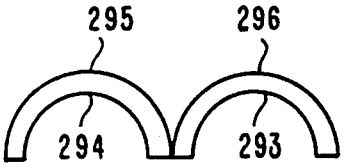
Figure 39C:
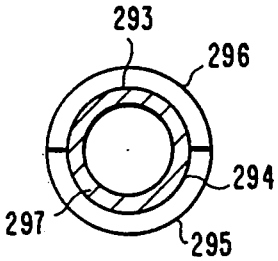

Referring to FIGS. 39A, 39B and 39C, there is diagrammatically illustrated four integral sections 293, 294, 295 and 296 which are hinged together by living hinges and able to be formed into a hollow, thermal insulation-filled tube for placement around a pipe 297 or other conduit or object.

Figure 40A:
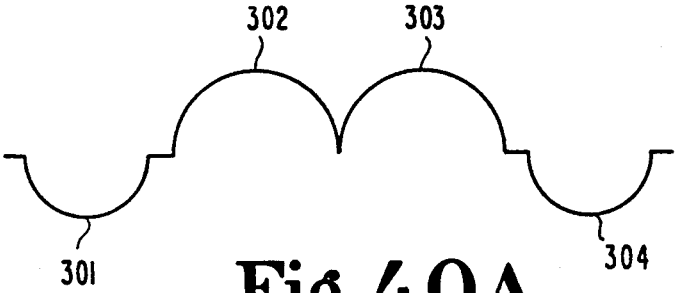
FIGS. 40A, 40B and 40C diagrammatically illustrate an alternative arrangement of four hinged sections which may be closed in order to create a generally hollow cylindrical tube according to the present invention.
Figure 40B:
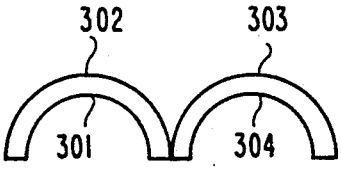
Figure 40C:
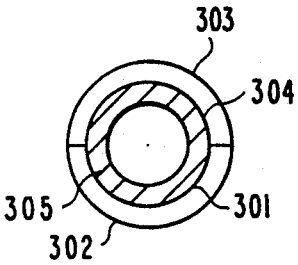

A still further variation of the present invention is diagrammatically illustrated in FIGS. 40A, 40B and 40C wherein the four sections 301, 302, 303 and 304 are integrally connected and hinged by living hinges for first creating the two clam shell halves which are illustrated in FIG. 40B. Thereafter, the two clam shell halves are hinged closed together in order to create the hollow generally cylindrical tubular shape of 40C for placement around tube 305. In each of these alternative arrangements, the hollow interior spaces are still formed in each clam shell half and filled with a loose-fill thermal insulation or a liquid foam-in-place thermal insulation. Another option for filling the hollow interior spaces which are formed in each of the various embodiments of the invention where there are clam shell halves is to use the alternating insulation strip design of assembly 205 as illustrated in FIG. 28 and fill or pack those hollow interior spaces with this alternating series of insulation strips. These alternating strips may be any of the various material combinations previously mentioned. It should be noted that in the clam shell design, there would be an outer as well as an inner cover or skin. The skin 208 of FIG. 28 may be used to provide either the inner cover or the outer cover of the clam shell designs of the various embodiments. In these various embodiments skin 208 may be used alone or as a lamination layer or may be substituted for by other means to hold the form of the alternating strips.

Figure 41:
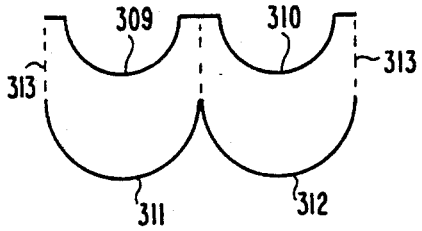
FIG. 41 is a diagrammatic illustration of a two-part assembly of hinged sections according to the present invention.

If the four sections are not configured as a single integral unit but rather as two separate halves, one possible configuration for these two halves is illustrated in FIG. 41 where the inside diameter sections 309 an 310 comprise an integral unit and the outside diameter sections 311 and 312 comprise a separate integral unit. Broken lines 313 show the direction of fitting the sections together into two clam shell halves. Once these two halves are completed and filled with thermal insulation, they are closed together in order to create a tubular or cylindrical shape around the pipe or conduit to be insulated.

Figure 42A:
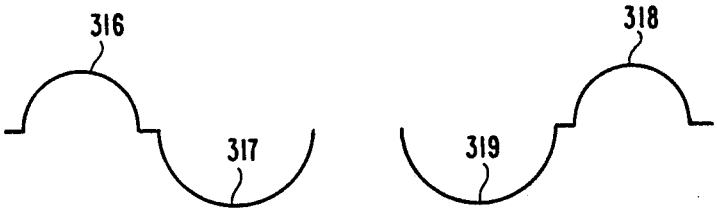
FIGS. 42A, 42B and 42C represent a two-part assembly, each part including two hinged sections which form two separate clam shell halves which may be joined together in order to create a generally cylindrical insulation tube according to the present invention.
Figure 42B:
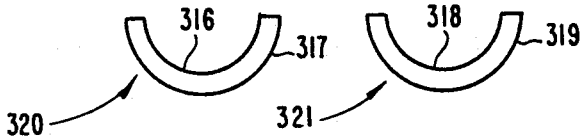
Figure 42C:
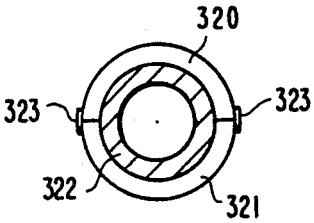

Another alternative embodiment for the two separate though integral assemblies is illustrated in FIGS. 42A, 42B, and 42C. Section 316 is an inside diameter section which is integrally connected and hinged to outside diameter section 317. Similarly, inside diameter section 318 is integrally connected and hinged to outside diameter section 319. After the outside diameter sections 317 and 319 are filled with insulation material, the respective inside diameter sections 316 and 318 are hinged closed thereby retaining the insulation material and resulting in the clam shell assembled shapes of FIG. 42B. Finally, the two insulation-filled clam shell halves 320 and 321 are joined together (FIG. 42C) into a hollow tube, the halves being secured together around a pipe 322 or similar tank or conduit by tape strips 323.

Figure 43:
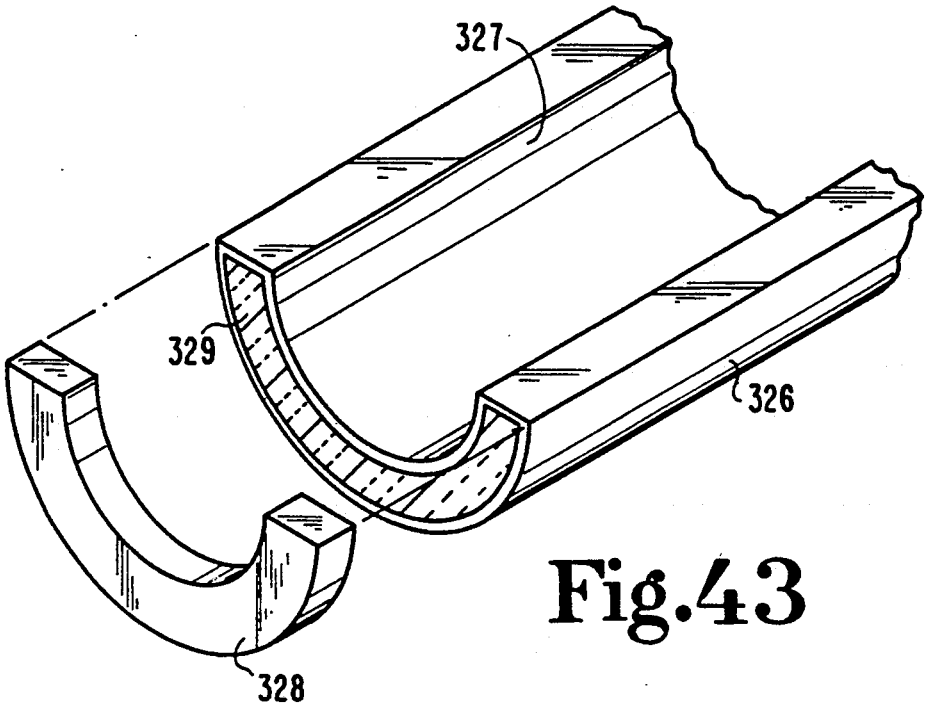
FIG. 43 is a diagrammatic, perspective, exploded view of an alternative arrangement of the present invention wherein the end cover is a separate component part.

Referring to FIG. 43, an alternative design is illustrated wherein annular lips such as 272 and 273 are omitted from the outside diameter sections and replaced by end caps. In FIG. 43, semi-cylindrical shell 325 includes outside diameter section 326 and inside diameter section 327 which is disposed in concentric relationship to section 326. End cap 328 fits over the end of sections 326 and 327. The inside of cap 328 is hollow and slides over both section 326 and 327 so as to completely enclose the insulation material 329 which is filled in the cavity between the two concentric sections.

Figure 44:
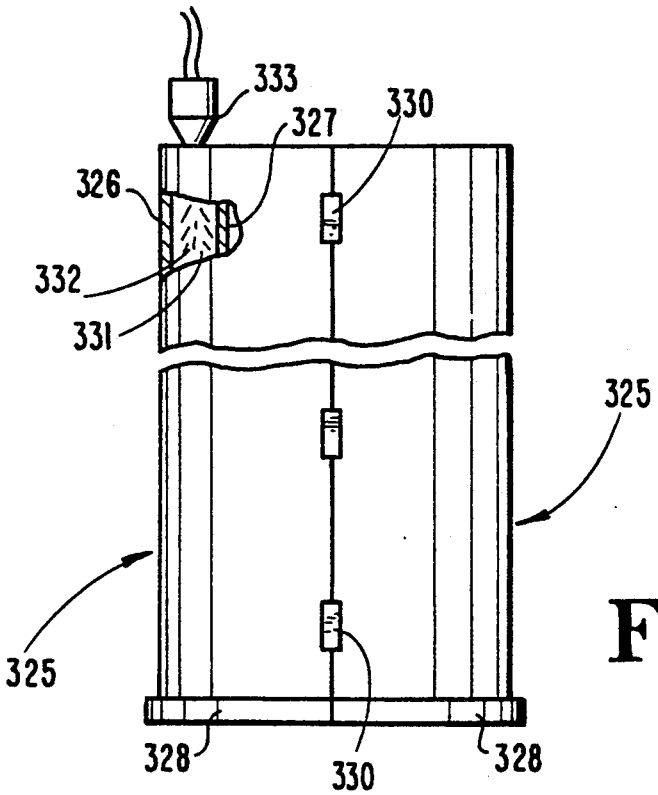
FIG. 44 is a diagrammatic, fragmentary front elevational view of two FIG. 43 halves joined together into a cylinder and turned on end for injection of liquid foam material.

Referring to FIG. 44 an arrangement for foaming the hollow interior space of the fabricated tubes of the present invention is illustrated. For illustrative purposes, the semi-cylindrical shell construction of FIG. 43 (shell 325) is used in the FIG. 44 arrangement, though initially without any insulation material 329 between the two sections. It should be noted that although FIG. 43 discloses only one shell 325, two such shells of virtually identical construction are used in order to fabricate a complete insulation cylinder. The two semi-cylindrical shells 325 are placed together and secured in place by tape strips 330. Only one end of each assembly of outside diameter section 326 and inside diameter section 327 is closed with covering end caps 328. The opposite end of each shell 325 is open leaving the cavity 331 between sections 326 and 327 in each shell accessible. Liquid foam-in-place insulation material 332 is injected into cavity 331 by nozzle 333. This filling of liquid foam insulation into the hollow cavities occurs in each shell and when the foaming is completed, another covering end cap is secured over the top open end of each shell. The finished assembly which is thereby created is a thermally insulated tube wherein the liquid foam-in-place insulation is completely encased in the shell covering both as to the inside diameter surface, the outside diameter surface and the ends. This tube of thermal insulation material may then be placed over sections of pipe or similar tanks or conduits.

Figure 45:
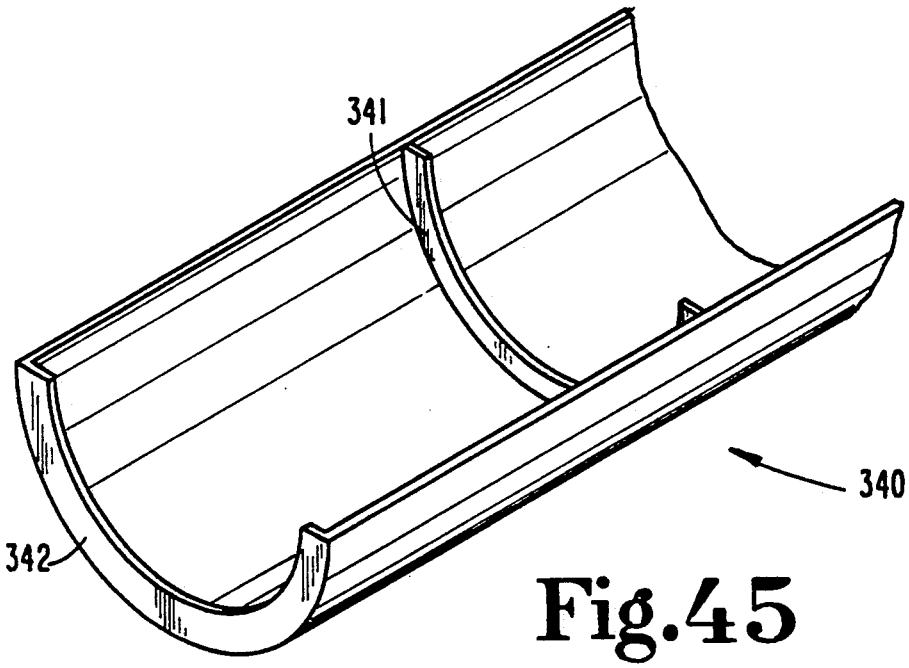
FIG. 45 is a diagrammatic perspective view of an alternative structural arrangement for use as part of the present invention.

Referring to FIG. 45, there is illustrated a further option for use with the present invention. Section 340 is intended to generically represent the various outer skins or sections of the clam shell constructions Previously described. Section 340 is hollow and semi-cylindrical and configured so as to be filed with insulation and then a hinged or inner cover member assembled thereto so as to create a generally semi-cylindrical tubular clam shell half for use in insulating around pipes, conduits, tanks and related members. In the event section 340 would need additional rigidity or stiffening due to either the material used for this shell portion or because of the length of section 340, it is envisioned that a stiffening rib 341 would be assembled (or integrally molded) every so many inches or feet along the length of section 340. The number and interval spacing of additional stiffening ribs 341 would of course depend upon a number of factors such as the size, weight, material selection and application. It is anticipated that the size, shape and design of stiffening rib 341 would be virtually identical to that of end lip or panel 342 such that their inside diameter edges would complement one another such that when the enclosing or covering member was hinged into position, a fairly uniform part-cylindrical center opening would be created so as to be compatible with the object to be insulated.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A water heater comprising:

a generally cylindrical inner tank arranged so as to have a top end and an oppositely disposed lower end;

a generally cylindrical outer shell disposed about said inner water tank and defining therewith an annular clearance space therebetween, said outer shell being arranged so as to have an upper edge and an oppositely disposed lower edge;

insulation means disposed in said annular space;

a top cover having an outer casing and a panel of insulation material disposed in said outer casing, said panel of insulation material being shaped so as to define a generally central recess which is suitably sized, shaped and positioned to fit over the top end of said inner tank; and a bottom cover having an outer casing and a panel of insulation material disposed in said outer casing, said panel of insulation material being shaped so as to define a generally central recess which is suitably sized, shaped and positioned to fit over the lower end of said inner tank.

2. The water heater of claim 1 wherein the outer casing of said top cover includes a generally cylindrical, outer peripheral wall and inset therefrom a generally cylindrical inner lip which is attached to the inside surface of said peripheral wall, said lip being shaped so as to define between said lip and said peripheral wall an open receiving channel, said receiving channel receiving therein the upper edge of said outer shell.

3. The water heater of claim 2 wherein the outer casing of said bottom cover includes a generally cylindrical, outer peripheral wall and inset therefrom a generally cylindrical inner lip which is attached to the inside surface of said peripheral wall, said lip being shaped so as to define between said lip and said peripheral wall an open receiving channel, said receiving channel therein receiving the lower edge of said outer shell.

4. A water heater comprising:

a generally cylindrical inner tank arranged so as to have a top end and an oppositely disposed lower end;

a generally cylindrical outer shell disposed about said inner water tank and defining therewith an annular clearance space therebetween, said outer shell being arranged so as to have an upper edge and an oppositely lower edge;

insulation means disposed in said annular space; and a top cover having an outer casing and a panel of insulation material disposed in said outer casing, said panel of insulation material being shaped so as to define a generally central recess which is suitably sized, shaped and positioned to fit over the top end of said inner tank, wherein the outer casing of said top cover includes a generally cylindrical, outer peripheral wall and inset therefrom a generally cylindrical inner lip which is attached to the inside surface of said peripheral wall, said lip being shaped so as to define between said lip and said peripheral wall an open receiving channel, said receiving channel receiving the upper edge of said outer shell.

5. A water heater comprising:

a generally cylindrical inner water tank including an operational control assembled to said inner water tank;

a generally cylindrical outer shell disposed about said inner tank and defining therewith an annular clearance space therebetween, said outer shell having spaced apart axial edges arranged in order to define an open clearance channel extending from the top of said shell to the bottom of said shell for access to said operational control;

insulation means disposed in said annular clearance space arranged to terminate prior to encountering said operational control; and a control cover configured to fit over said operational control and extending the entire length of said clearance channel, said control cover being attached securely and directly to said outer shell, said control cover including an access door positioned over said operational control whereby opening of said access door provides access to said operational control.

6. The water heater of claim 5 which includes a second operational control and wherein said control cover includes a second access door disposed over said second operational control.

7. A water heater comprising:

a generally cylindrical inner water tank;

a generally cylindrical outer insulation panel disposed circumferentially around said water tank, said insulation panel including:

(a) a flexible cover having two oppositely disposed, axially extending free ends which are joined together to complete said generally cylindrical shape and said flexible cover having an inside diameter size greater than the outside diameter size of said water tank; and (b) a plurality of spaced apart insulation blocks attached to said flexible cover and extending for virtually the entire axial height of said flexible cover; and insulation means disposed between said spaced apart insulation block within the space between said shell and said tank, wherein the insulation blocks are fabricated from a rigid insulation material and wherein said insulation means includes panels of flexible insulation material.

8. A water heater comprising:

a generally cylindrical inner water tank; and a generally cylindrical outer insulation panel disposed circumferentially around said water tank, said insulation panel including:

(a) a flexible cover having two oppositely disposed, axially extending free ends which are joined together to complete said generally cylindrical shape, said flexible cover having an inside diameter size greater than the outside diameter size of said water tank;

(b) insulation means received by said flexible cover and having a thickness at least equal to the distance of radial separation between said tank and said cover; and (c) said cover further includes a skin and a plurality of honeycomb pockets joined to said skin, each honeycomb pocket of said plurality receiving a portion of said insulation means disposed therein, each of said honeycomb pockets having a depth substantially equal to the radial width of said annular clearance space and the free height of each portion of said insulation means being greater than the depth of each honeycomb pocket such that each portion of said insulation means is compressed down into its corresponding honeycomb pocket in the configuration of the assembled water heater.

9. A water heater comprising:

a generally cylindrical inner water tank;

a first hollow, generally semi-cylindrical shell half disposed circumferentially around a portion of said water tank;

a second hollow, generally semi-cylindrical shell half disposed circumferentially around a portion of said water tank, said second semi-cylindrical shell half cooperatively arranged with said first semi-cylindrical shell half in order to provide a generally cylindrical shell disposed around the entirely of said inner water tank;

a plurality of flexible insulation material strips disposed within said first hollow generally semi-cylindrical shell half;

a plurality of rigid insulation material strips disposed in said first hollow generally semi-cylindrical shell half, said flexible insulation material strips and said rigid insulation material strips being arranged in an alternating sequence in said shell half;

a plurality of flexible insulation material strips disposed within said second hollow generally semi-cylindrical shell half; and a plurality of rigid insulation material strips disposed within said second hollow generally semi-cylindrical shell half, said flexible insulation material strips and said rigid insulation material strips being arranged in an alternating sequence in said second shell half.

* * * * *

UNITED STATES PATENT AND TRADEMARK OFFICE

CERTIFICATE OF CORRECTION

PATENT NO. : 5,005,531

DATED : April 9, 1991

INVENTOR(S) : Thomas E. Nelson

It is certified that error appears in the above-identified patent and that said Letters Patent is hereby corrected as shown below:

In column 18, line 43, please change "gater" to --outer--.

Signed and Sealed this

Twenty-fifth Day of August, 1992

*Attest:*

DOUGLAS B. COMER

*Attesting Officer*

*Acting Commissioner of Patents and Trademarks*